US012655841B2

(12) United States Patent
Li et al.

(10) Patent No.: US 12,655,841 B2
(45) Date of Patent: Jun. 16, 2026

(54) FLOW DISTRIBUTOR ASSEMBLY, VALVE BOX AND PLUNGER PUMP

(71) Applicant: YANTAI JEREH PETROLEUM EQUIPMENT & TECHNOLOGIES CO., LTD., Yantai (CN)

(72) Inventors: Xiaobin Li, Yantai (CN); Jixin Wang, Yantai (CN); Wenping Cui, Yantai (CN); Baojie Wang, Yantai (CN); Xiaosong Wei, Yantai (CN); Zimeng Guo, Yantai (CN)

(73) Assignee: Yantai Jereh Petroleum Equipment & Technologies Co., Ltd., Yantai (CN)

( * ) Notice: Subject to any disclaimer, the term of this patent is extended or adjusted under 35 U.S.C. 154(b) by 0 days.

(21) Appl. No.: 19/054,464

(22) Filed: Feb. 14, 2025

(65) Prior Publication Data

US 2025/0188922 A1 Jun. 12, 2025

Related U.S. Application Data

(63) Continuation of application No. PCT/CN2022/132556, filed on Nov. 17, 2022.

(30) Foreign Application Priority Data

Aug. 15, 2022 (CN) ..... 202210974401.1

(51) Int. Cl.
*F04B 53/10* (2006.01)
*F04B 53/04* (2006.01)

(52) U.S. Cl.
CPC ..... *F04B 53/10* (2013.01); *F04B 53/04* (2013.01)

(58) Field of Classification Search
CPC ..... F04B 53/10; F04B 53/04; F04B 53/16; F04B 53/00

(Continued)

(56) References Cited

U.S. PATENT DOCUMENTS

RE14,424 E * 1/1918 Scoville ..... 137/516.29
3,309,014 A * 3/1967 Bauer ..... F16K 15/066 417/571

(Continued)

FOREIGN PATENT DOCUMENTS

CN 203560085 U 4/2014
CN 105952633 A 9/2016

(Continued)

OTHER PUBLICATIONS

International Search Report mailed May 1, 2023 for International Application No. PCT/CN2022/132556.

(Continued)

*Primary Examiner* — Benjamin Doyle
(74) *Attorney, Agent, or Firm* — Crowell & Moring LLP

(57) ABSTRACT

This disclosure describes a diverter assembly, a valve box, and a plunger pump. The diverter assembly includes a diverter, a first valve body, a second valve body, first valve rubber, and second valve rubber. The diverter includes liquid drainage and inlet holes. The liquid drainage hole is communicated with first and second end surfaces facing away from each other in an axial direction of the diverter, and the liquid inlet hole is communicated with a side surface and the first end surface. The first valve body is configured to block the liquid inlet hole and to communicate a communication hole and the liquid drainage hole. The second valve body is configured to block the liquid drainage hole. The first and second valve rubber is configured to hermetically connect the first valve body and the first end surface, and to seal the second valve body and the second end surface, respectively.

12 Claims, 13 Drawing Sheets

(58) Field of Classification Search
USPC ..... 417/454, 439
See application file for complete search history.

(56) References Cited

U.S. PATENT DOCUMENTS

| | | | | | |
|---|---|---|---|---|---|
| 4,413,647 | A | | 11/1983 | De Lorenzo et al. | |
| 4,551,077 | A | * | 11/1985 | Pacht | F04B 53/109 417/454 |
| 5,230,363 | A | * | 7/1993 | Winn, Jr. | F04B 53/109 417/571 |
| 5,302,087 | A | * | 4/1994 | Pacht | F04B 53/007 417/571 |
| 5,605,449 | A | * | 2/1997 | Reed | F04B 53/109 417/454 |
| 6,231,323 | B1 | * | 5/2001 | Jezek | F04B 53/164 137/493.9 |
| 9,188,122 | B1 | * | 11/2015 | Reed | F16K 15/066 |
| 10,113,653 | B2 | * | 10/2018 | Forrest | F16K 27/003 |
| 11,732,700 | B2 | * | 8/2023 | Argentino | F04B 53/109 417/523 |
| 11,859,611 | B2 | * | 1/2024 | Thomas | F04B 53/1022 |
| 2012/0187321 | A1 | * | 7/2012 | Small | F16K 27/0209 251/321 |
| 2015/0071803 | A1 | * | 3/2015 | Huang | F04B 39/1046 417/560 |
| 2019/0120389 | A1 | * | 4/2019 | Foster | F16K 1/443 |

FOREIGN PATENT DOCUMENTS

| | | | | | |
|---|---|---|---|---|---|
| CN | 205592126 | U | | 9/2016 | |
| CN | 206753890 | U | | 12/2017 | |
| CN | 207278237 | U | | 4/2018 | |
| CN | 110617211 | A | | 12/2019 | |
| CN | 111664087 | A | | 9/2020 | |
| CN | 211598974 | | * | 9/2020 | F04B 53/10 |
| CN | 211598974 | U | | 9/2020 | |
| CN | 214196636 | U | | 9/2021 | |
| CN | 113790151 | A | | 12/2021 | |
| CN | 115163478 | A | | 10/2022 | |

OTHER PUBLICATIONS

Written Opinion mailed May 1, 2023 for International Application No. PCT/CN2022/132556.
Office Action dated Apr. 1, 2023 for Chinese Patent Application No. 202210974401.1.
Chinese-language Search Report issued in Chinese Application No. 2022109744011 dated Mar. 31, 2023 (3 pages).

* cited by examiner

FLOW DISTRIBUTOR ASSEMBLY, VALVE BOX AND PLUNGER PUMP

CROSS-REFERENCE TO RELATED APPLICATIONS

The present disclosure is based on and claims the benefit of priority to PCT Application No. PCT/CN2022/132556, filed on Nov. 17, 2022, which is based on and claims the benefit of priority to Chinese Patent Application No. 202210974401.1, filed with the China National Intellectual Property Administration on Aug. 15, 2022 and entitled "FLOW DISTRIBUTOR ASSEMBLY, VALVE BOX AND PLUNGER PUMP", which is incorporated herein by reference in its entirety.

TECHNICAL FIELD

This disclosure relates to the technical field of oil and gas production equipment, and in particular, to a diverter assembly, a valve box, and a plunger pump.

BACKGROUND

A plunger pump is an important piece of equipment in an oil and gas production process. The plunger pump usually includes a hydraulic end and a power end. The power end may transmit kinetic energy to the hydraulic end through a reduction transmission system and the like. Force generated by a high-pressure liquid inside the hydraulic end acts on a power end housing through components such as a plunger. In some cases, the plunger pump is usually provided with an upper valve assembly and a lower valve assembly. When the power end drives the plunger to move in a direction away from the hydraulic end, the upper valve assembly is closed and the lower valve assembly is opened to complete a liquid inlet action. When the power end drives the plunger to move in a direction closer to the hydraulic end, the lower valve assembly is closed and the upper valve assembly is opened to complete a liquid draining action.

In some cases, in the plunger pump, the upper valve assembly and the lower valve assembly are distributed in a direction perpendicular to an axial direction of the plunger, so that open holes in a valve box of the plunger pump are distributed in a cross-intersecting manner. An axial hole configured to provide activity space for the plunger and a radial hole configured to mount the upper valve assembly and the lower valve assembly are prone to a stress concentration phenomena when liquid flows, and a position with high stress is located in an alternating area, so that fatigue cracks are easily generated at intersecting lines of the valve box, damage to the valve box occurs, and service lives of the valve box and the plunger pump are seriously affected (reduced).

SUMMARY

This disclosure describes a diverter assembly, a valve box, and a plunger pump to solve a problem that a current valve box is provided with an open hole in a cross-intersecting structure to accommodate a plunger and a valve assembly, which is prone to a stress concentration phenomenon in a liquid flowing process and damage to the valve box.

To solve the foregoing problems, this disclosure adopts the following technical solutions.

According to a first aspect, this disclosure describes a diverter assembly, applied to a plunger pump. The diverter assembly includes a diverter, a first valve body, a second valve body, first valve rubber, and second valve rubber. The diverter is provided with a liquid drainage hole and a liquid inlet hole. The liquid drainage hole is communicated with a first end surface and a second end surface facing away from each other of the diverter in an axial direction of the diverter. The liquid inlet hole is communicated with a side surface and the first end surface of the diverter. The side surface is connected between the first end surface and the second end surface. An orifice of the liquid inlet hole located in the side surface is capable of being communicated with a liquid inlet channel of a valve box of the plunger pump. An orifice of the liquid drainage hole located in the second end surface is capable of being communicated with a liquid drainage channel of the valve box. The first valve body is provided with a communication hole penetrating through the first valve body in the axial direction. The first valve body is in openable and closable surface contact with the first end surface of the diverter to block the liquid inlet hole and to communicate the communication hole and the liquid drainage hole. The second valve body is in openable and closable surface contact with the second end surface of the diverter to block the liquid drainage hole. Both the first valve rubber and the second valve rubber surround outside the liquid drainage hole. The liquid inlet hole is spaced apart from the liquid drainage hole through the first valve rubber. The first valve rubber is capable of being pressed between the first valve body and the first end surface. The second valve rubber is capable of being pressed between the second valve body and the second end surface.

According to a second aspect, an embodiment of this disclosure describes a valve box, applied to a plunger pump. The valve box has an inner cavity, a liquid inlet channel, and a liquid drainage channel. The inner cavity is configured to mount a diverter assembly. The liquid inlet channel is communicated with a liquid inlet hole of the diverter assembly. The liquid drainage channel is capable being communicated with a liquid drainage hole of the diverter assembly.

According to a third aspect, an embodiment of this disclosure describes a plunger pump, including a plunger, the foregoing diverter assembly, and the foregoing valve box. Both the plunger and the diverter assembly are mounted in an inner cavity of the valve box. The plunger is in transmission connection with the first valve body.

BRIEF DESCRIPTION OF THE DRAWINGS

Accompanying drawings described herein are used to provide a further understanding of this disclosure and constitute a part of this disclosure. Exemplary embodiments of this disclosure and descriptions thereof are used to explain this disclosure, and do not constitute any inappropriate limitation to this disclosure. In the accompanying drawings.

REFERENCE SIGNS IN THE DRAWINGS

100—diverter, 101—matrix, 102—first wear ring, 103—second wear ring, 110—liquid drainage hole, 120—liquid inlet hole, 121—first hole segment, 122—second hole segment, 140—limiting slot, 150—disassembling and assembling thread, 160—connecting hole, 210—first valve body, 211—communication hole, 220—second valve body, 230—valve spring, 240—spring holder, 310—first valve rubber, 320—second valve rubber, 330—third valve rubber, 410—sealing ring, 420—sealing loop, 500—valve box, 501—high-pressure cavity, 502—low-pressure cavity, 503—alternating cavity, 510—inner cavity, 520—liquid inlet channel, 530—liquid drainage channel, 540—discharge hole, 710—plunger, 720—gland, 730—pressing cap, 740—packing assembly, 751—packing pressing cap, 752—packing pressing ring, 753—packing spacing ring, 760—packing wear sleeve, and 770—clamp.

DETAILED DESCRIPTION

To make objectives, technical solutions, and advantages of this disclosure clearer, the technical solutions of this disclosure will be described below with reference to specific embodiments of this disclosure and the accompanying drawings. Apparently, the described embodiments are mere example of this disclosure. All other embodiments obtained by a person of ordinary skill in the art based on the embodiments of this disclosure without creative efforts fall within the protection scope of this disclosure.

Technical solutions disclosed in various embodiments of this disclosure are described in detail below with reference to accompanying drawings.

Figure 1:
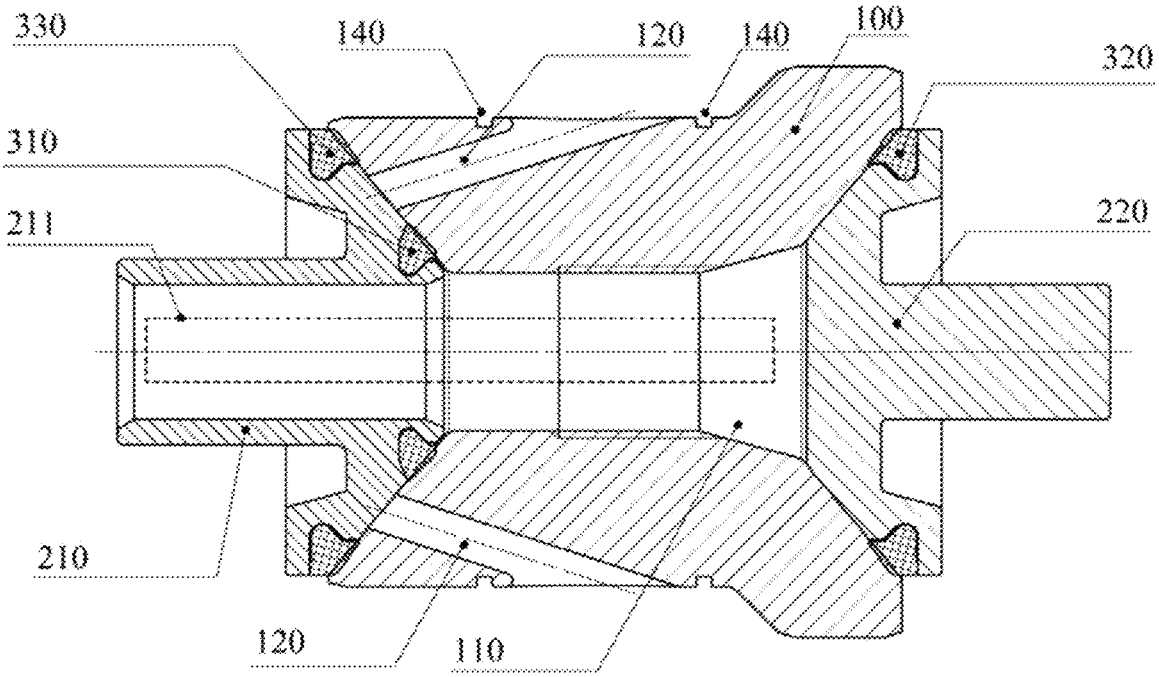
FIG. 1 is a schematic structural diagram of a diverter assembly according to an embodiment of this disclosure.
Figure 13:
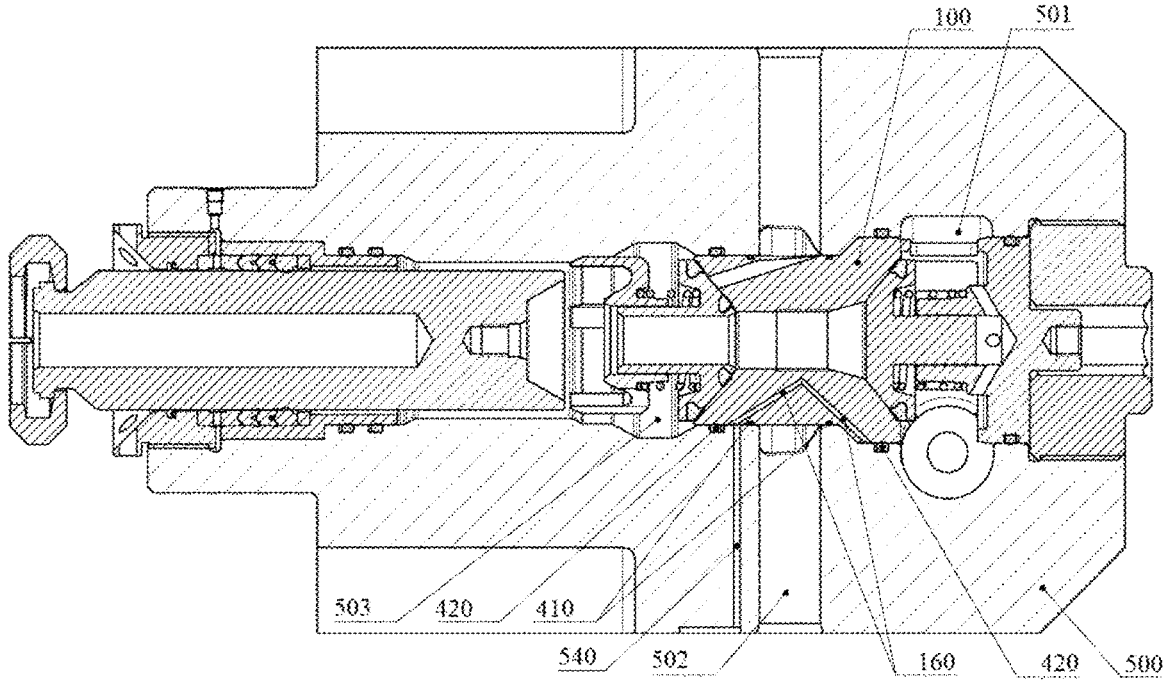
FIG. 13 is another schematic structural diagram of a plunger pump according to an embodiment of this disclosure.
Figure 14:
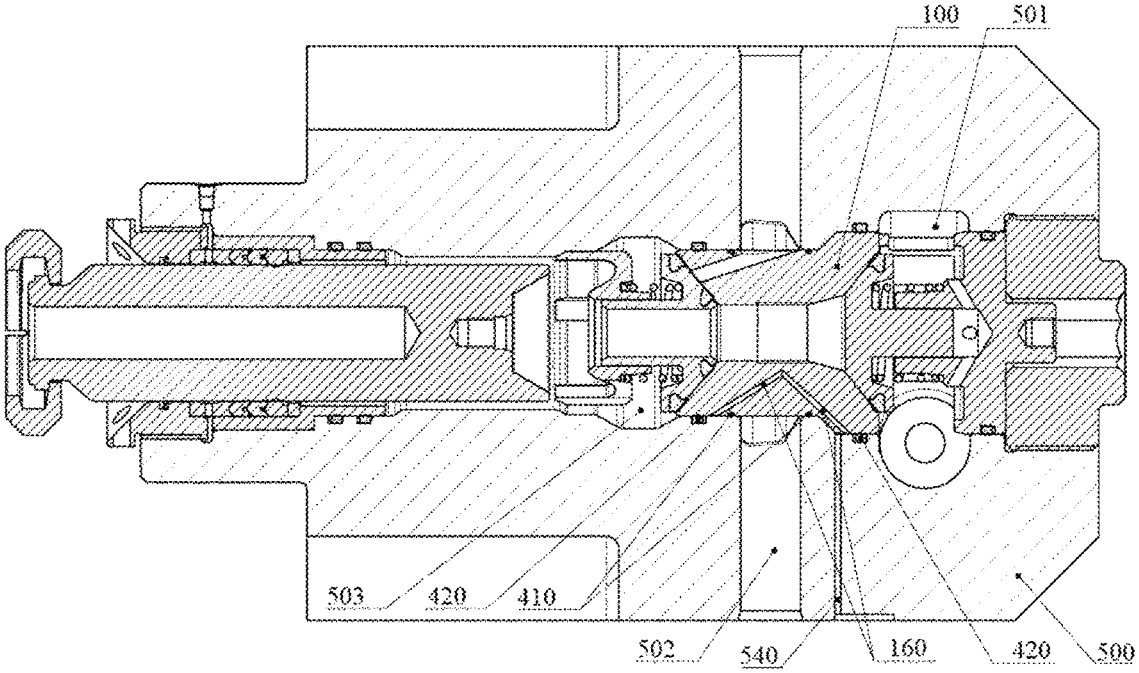
FIG. 14 is still another schematic structural diagram of a plunger pump according to an embodiment of this disclosure.
Figure 15:
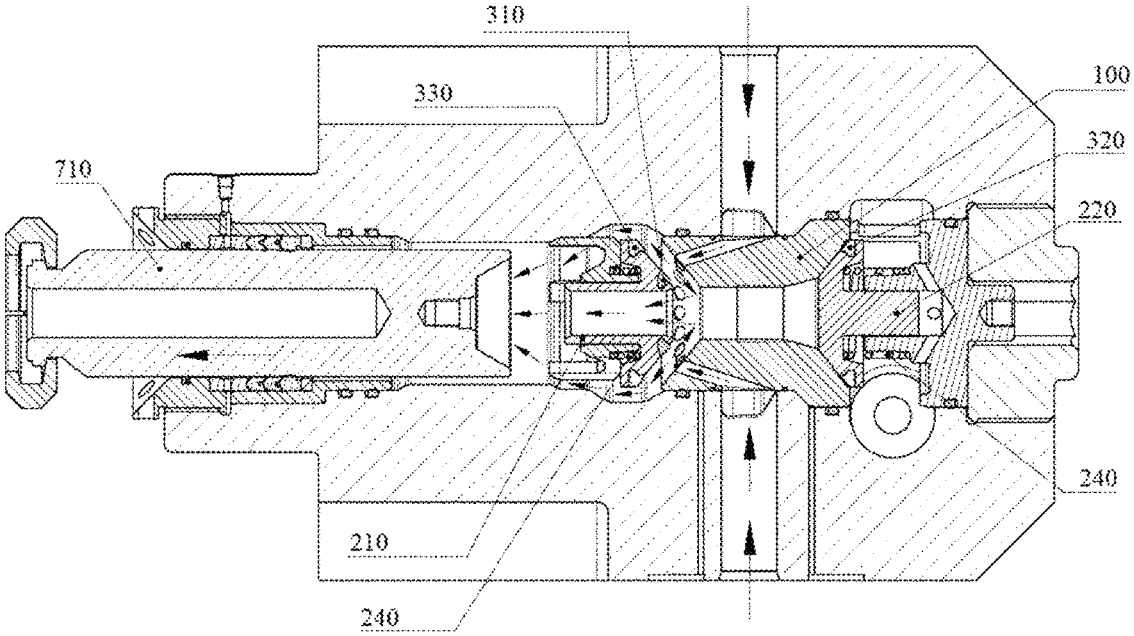
FIG. 15 is a schematic diagram of a liquid inlet process of a plunger pump according to an embodiment of this disclosure.
Figure 16:
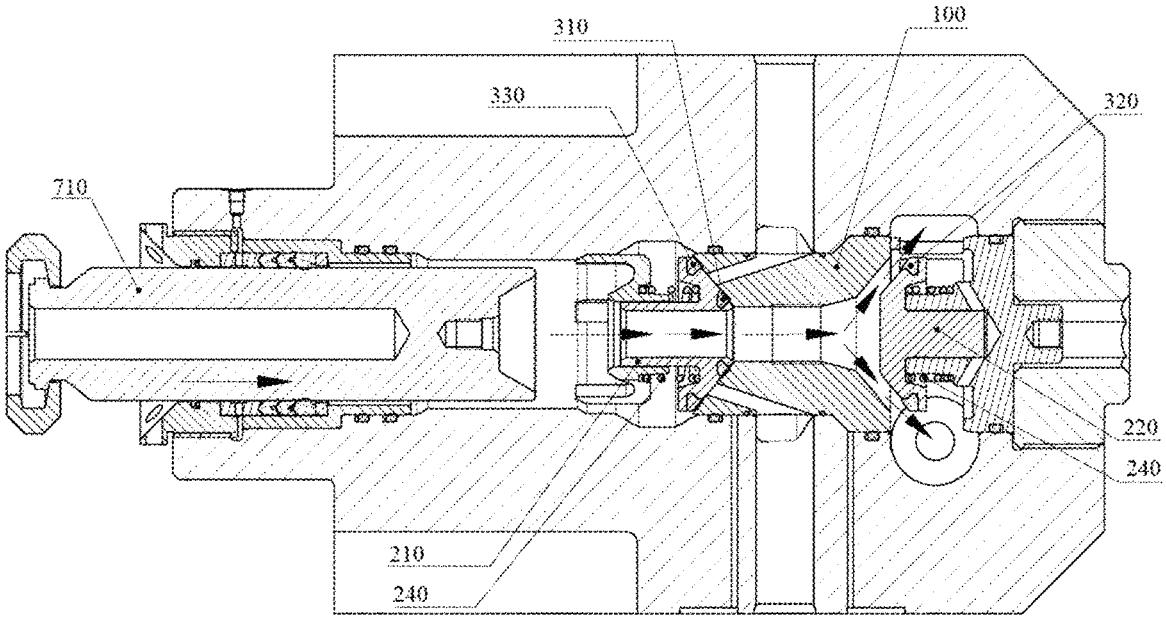
FIG. 16 is a schematic diagram of a liquid draining process of a plunger pump according to an embodiment of this disclosure.

As shown in FIG. 1, an embodiment of this disclosure discloses a diverter assembly. The diverter assembly may be applied to a plunger pump. Specifically, as shown in FIGS. 11-16, the plunger pump further includes a valve box 500 and a plunger 710. The valve box 500 is provided with an inner cavity 510, a liquid inlet channel 520, and a liquid drainage channel 530. The diverter assembly may be mounted in the inner cavity 510 of the valve box 500, and the diverter assembly is communicated with both the liquid inlet channel 520 and the liquid drainage channel 530 of the valve box 500. The diverter assembly fits with the plunger 710. The plunger 710 is in transmission connection with a power end in the plunger pump, so that the plunger 710 performs reciprocating motion in the inner cavity 510 of the valve box 500 under driving of the power end, and the diverter assembly is cyclically switched between a liquid inlet process and a liquid draining process (as shown in FIG. 15 and FIG. 16). Certainly, the plunger pump further includes components such as a gland 720, a pressing cap 730, and a packing assembly 740. Considering brief text, the components are not introduced one by one herein again.

As shown in FIG. 1 to FIG. 10, the diverter assembly includes a diverter 100, a first valve body 210, a second valve body 220, first valve rubber 310, and second valve rubber 320. Both the first valve rubber 310 and the second valve rubber 320 are configured to provide a sealing function. Therefore, both the first valve rubber and the second valve rubber may be made of a material having relatively good elasticity such as rubber. Parameters such as a cross-sectional shape and a size of the first valve rubber and the second valve body may be determined according to an actual requirement, and are not limited herein. To ensure that both the first valve rubber 310 and the second valve rubber 320 provide a reliable sealing effect, both the first valve rubber 310 and the second valve rubber 320 may be annular structural components.

Figure 2:
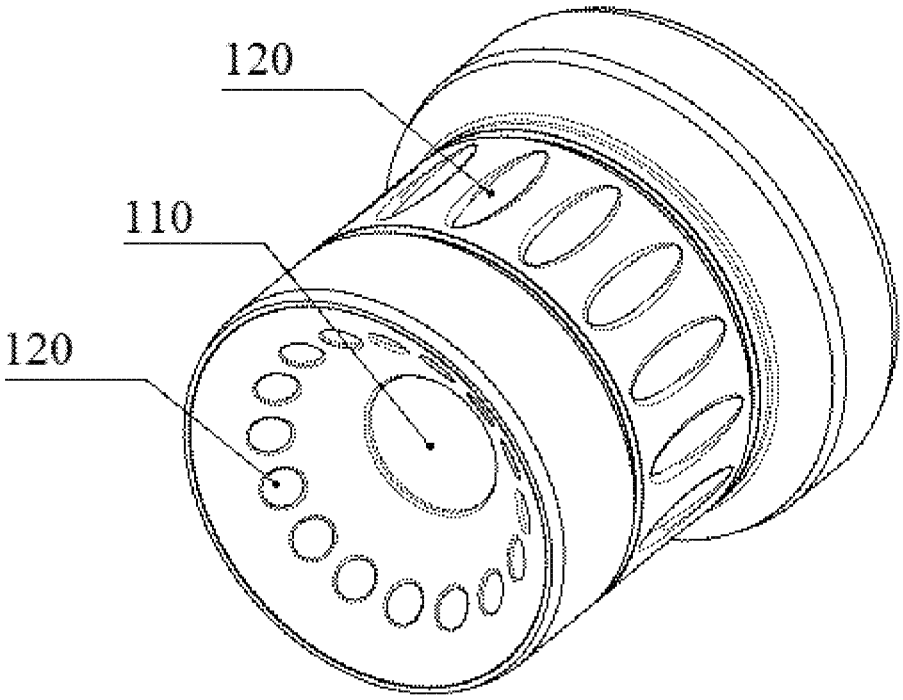
FIG. 2 is a schematic structural diagram of a diverter in a diverter assembly according to an embodiment of this disclosure.
Figure 3:
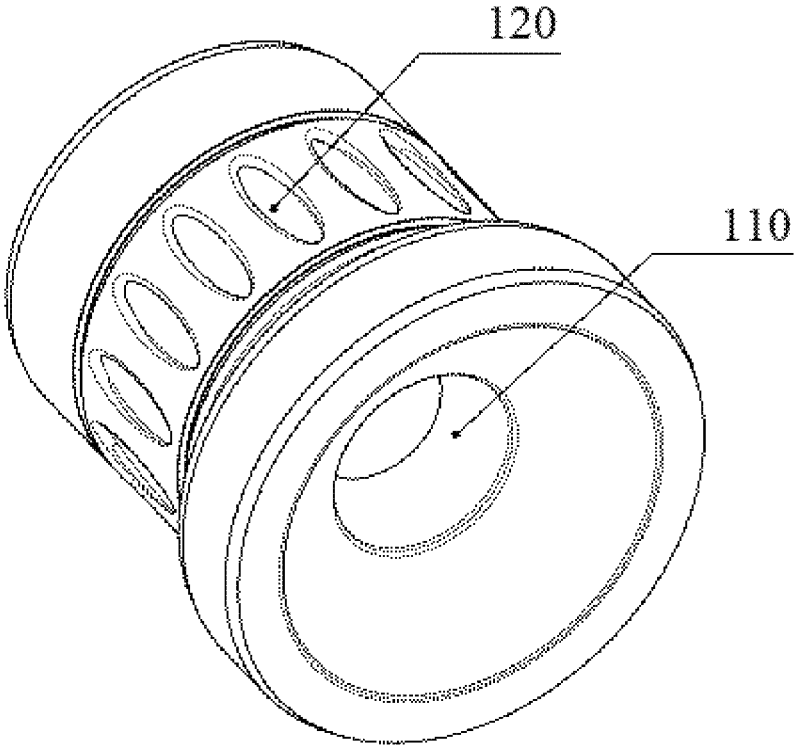
FIG. 3 is a schematic structural diagram of the structure shown in FIG. 2 in another direction.
Figure 4:
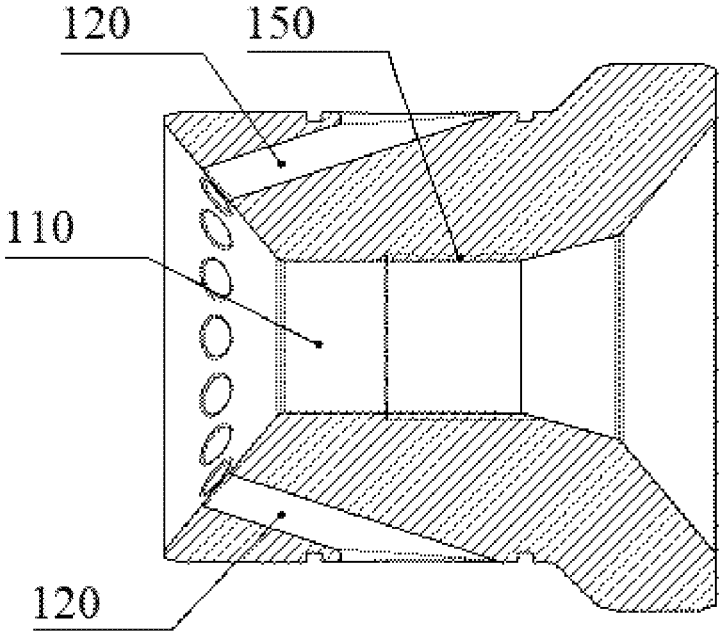
FIG. 4 is a cross-sectional schematic diagram of the structure shown in FIG. 2.
Figure 5:
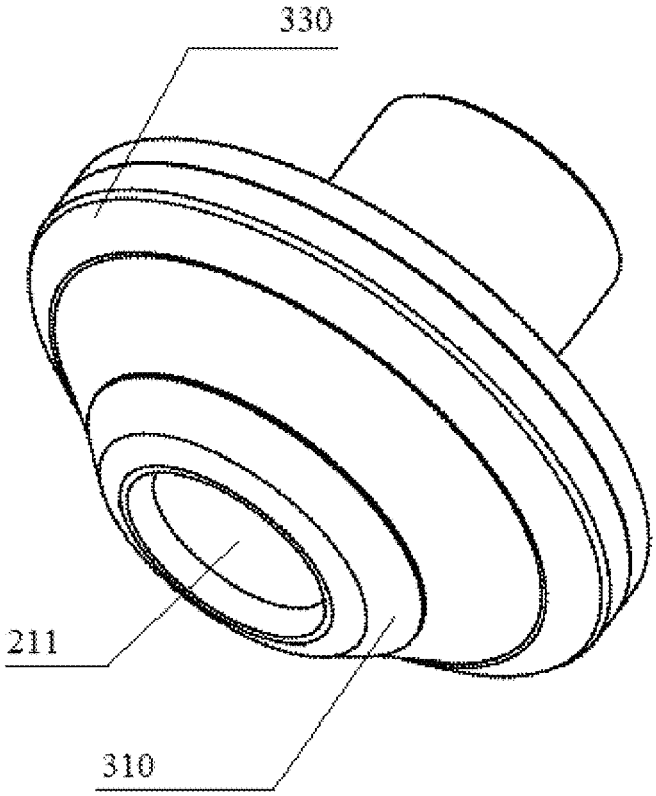
FIG. 5 is a schematic diagram of a partial structure of a diverter assembly including a first valve body according to an embodiment of this disclosure.
Figure 6:
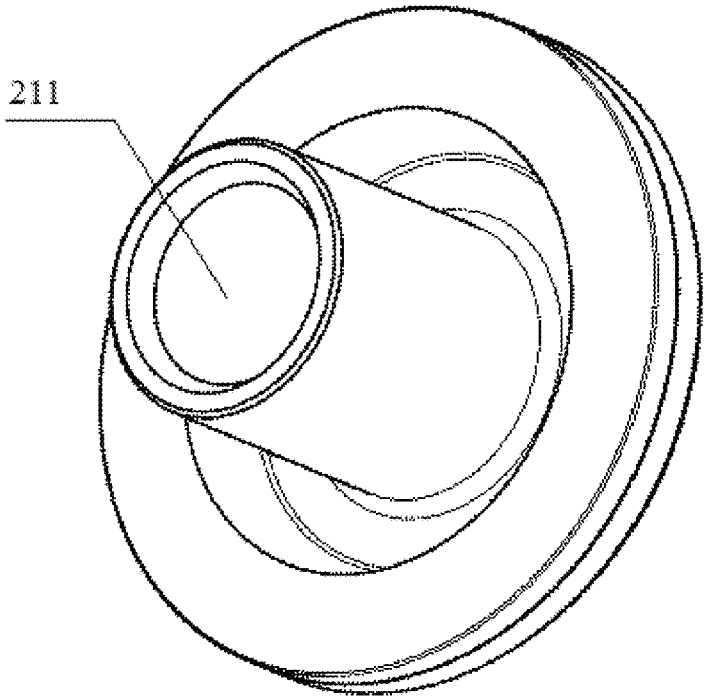
FIG. 6 is a schematic structural diagram of the structure shown in FIG. 5 in another direction.

As shown in FIG. 2 and FIG. 4, the diverter 100 is provided with a liquid drainage hole 110 and a liquid inlet hole 120, and the liquid drainage hole 110 and the liquid inlet hole 120 are spaced apart from each other. That is, both the liquid drainage hole 110 and the liquid inlet hole 120 are independent channels formed in the diverter 100, to ensure that a liquid draining process and a liquid inlet process can not interfere with each other. In addition, structures such as a disassembling and assembling thread 150 for facilitating disassembling of the diverter 100 may be arranged on the diverter 100.

The liquid drainage hole 110 is communicated with a first end surface and a second end surface facing away from each other of the diverter 100 in an axial direction of the diverter 100. That is, the liquid drainage hole 110 penetrates through the diverter 100 in the axial direction of the diverter 100, so that spaces at two ends facing away from each other of the diverter 100 may be communicated with each other through the liquid drainage hole 110. A cross section of the liquid drainage hole 110 may be triangular, rectangular, or the like. To reduce resistance to liquid flow, the cross section of the liquid drainage hole 110 may be circular.

The liquid inlet hole 120 is communicated with a side face and the first end surface of the diverter 100. The side face is connected between the first end surface and the second end surface of the diverter 100, so that spaces where the first end surface and the side face of the diverter 100 are located may be communicated by the liquid inlet hole 120, a periphery of the side face of the diverter 100 may be used as a liquid inlet space, a space on one side of the first end surface of the diverter 100 may be used as a liquid temporary storage space, and a space on one side of the second end surface of the diverter 100 may be used as a liquid drainage space.

Correspondingly, to ensure that the liquid inlet process and the liquid draining process can be normally performed after the diverter assembly is mounted in the valve box 500 of the plunger pump, without interference from other factors, with reference to FIG. 11, FIG. 12, FIG. 15, and FIG. 16, an orifice of the liquid inlet hole 120 located in the side surface is communicated with the liquid inlet channel 520 of the valve box 500 of the plunger pump, and an orifice of the liquid drainage hole 110 located in the second end surface is communicated with the liquid drainage channel 530 of the valve box 500, thereby ensuring that a liquid can flow through the liquid inlet channel 520 of the valve box 500 and flows into the space on the side where the first end surface of the diverter 100 is located through the liquid inlet hole 120 to complete the liquid inlet process. Then, in a case that the liquid inlet hole 120 is closed, the liquid temporarily stored in the space on the side where the first end surface is located can flow from the liquid drainage hole 110 of the diverter 100 to the space on the side where the second end surface of the diverter 100 is located to complete the liquid draining process.

Figure 12:
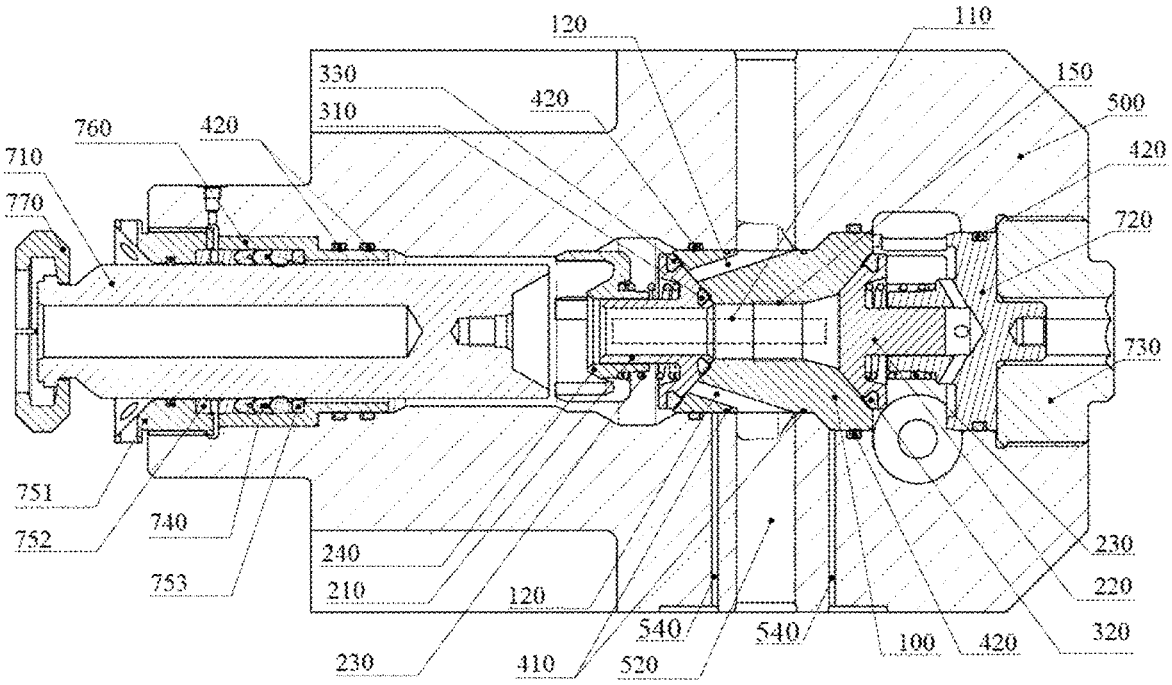
FIG. 12 is a cross-sectional schematic diagram of a plunger pump according to an embodiment of this disclosure.

To ensure that the liquid draining process and the liquid inlet process are independent of each other, components such as the first valve body 210, the second valve body 220, the first valve rubber 310, and the second valve rubber 320 need to provide a blocking function for the diverter 100. Specifically, when the liquid inlet process is performed, an orifice of at least one end of the liquid drainage hole 110 needs to be closed. In addition, one orifice of the liquid drainage hole 110 is located on the same side as the liquid inlet hole 120, and a power source for switching the liquid inlet process and the liquid draining process is the plunger 710 that performs reciprocating motion in the axial direction. Therefore, as shown in FIG. 15, in the liquid inlet process, the orifice of the liquid drainage hole 110 located in the second end surface may be blocked. Similarly, because the power source for switching the liquid inlet process and the liquid draining process is the plunger 710 that performs reciprocating motion in the axial direction, as shown in FIG. 16, liquid draining process is performed, the orifice of the liquid inlet hole 120 located in the first end surface may be blocked. Certainly, to ensure that the first valve body 210 and the second valve body 220 can generate corresponding displacement in the liquid inlet process and the liquid draining process, as shown in FIG. 12, both the first valve body 210 and the second valve body 220 may be provided with valve springs 230, and the valve springs 230 may be mounted on a spring holder 240.

In detail, a component configured to block the orifice of the liquid inlet hole 120 may include the foregoing first valve body 210, and a component configured to block the orifice of the liquid drainage hole 110 may be the foregoing second valve body 220. Certainly, to ensure that the orifice of the liquid drainage hole 110 cannot be blocked together in a process of blocking the orifice of the liquid inlet hole 120 by using the first valve body 210, a corresponding penetrating structure may be arranged on the first valve body 210.

Figure 7:
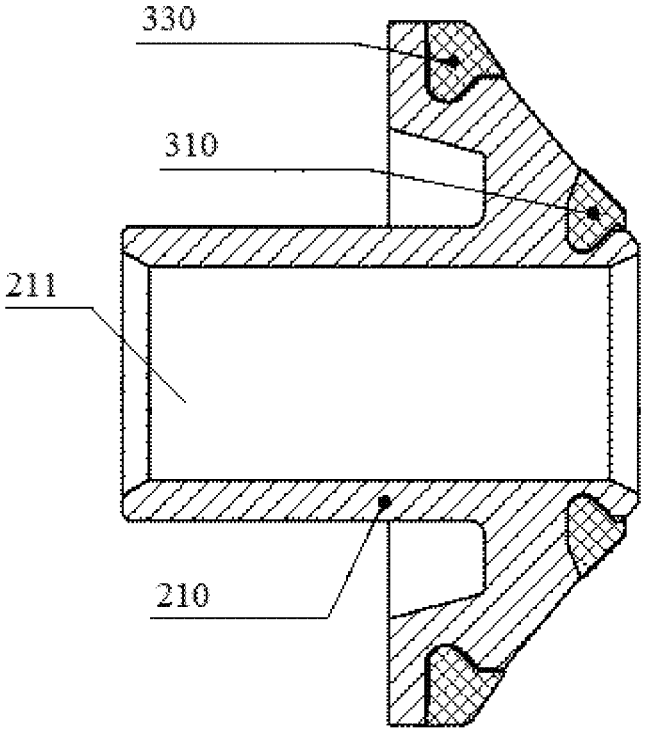
FIG. 7 is a cross-sectional schematic diagram of the structure shown in FIG. 5.
Figure 8:
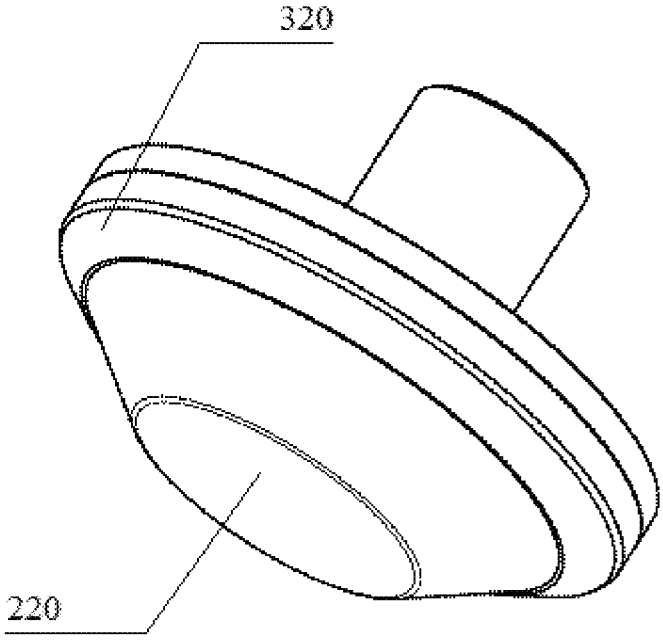
FIG. 8 is a schematic diagram of a partial structure of a diverter assembly including a second valve body according to an embodiment of this disclosure.
Figure 9:
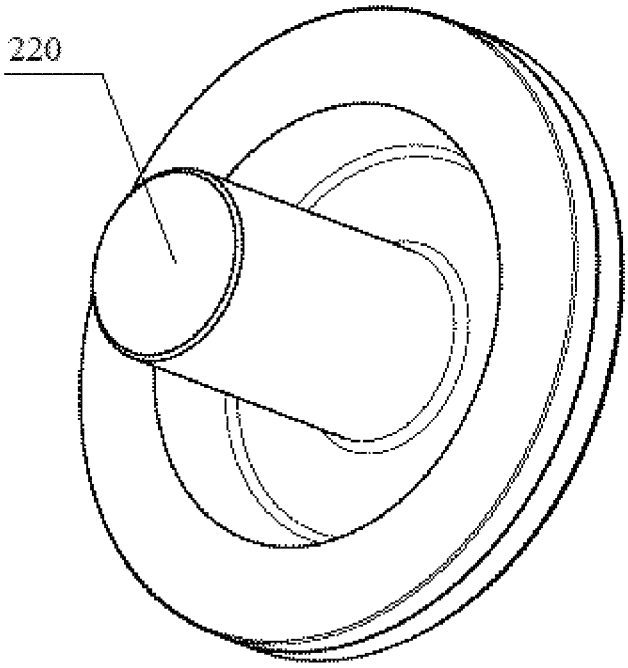
FIG. 9 is a schematic structural diagram of the structure shown in FIG. 8 in another direction.

Specifically, as shown in FIG. 7, the first valve body 210 is provided with a communication hole 211 (that is, the foregoing penetrating structure) that penetrates through the first valve body 210 in the axial direction of the diverter 100, so as to avoid the liquid drainage hole 110 of the diverter 100 by using the communication hole 211 in a process of blocking the liquid inlet hole 120 through the first valve body 210. The communication hole 211 and the liquid drainage hole 110 are oppositely provided in the axial direction of the diverter 100, and cross-sectional area of the communication hole 211 may be greater than or smaller than cross-sectional area of the liquid drainage hole 110. To improve smoothness of the liquid draining process, cross-sectional area of the communication hole 211 and the liquid drainage hole 110 may be slightly different (or be substantially similar), cross-sectional shapes of the communication hole 211 and the liquid drainage hole 110 may be similar or the same, and axes of the communication hole 211 and the liquid drainage hole 110 may be coincide.

As shown in FIG. 1, the first valve body 210 may be in openable and closable surface contact with the first end surface to block the liquid inlet hole 120 and communicate the communication hole 211 and the liquid drainage hole 110. That is, in the diverter assembly, the first valve body 210 has a capability of moving relative to the diverter 100, and in a process that the first valve body 210 moves in a direction closer to the diverter 100, the first valve body 210 may move to a state of being in surface contact with the first end surface of the diverter 100. In this state, the first valve body 210 can block, in a surface contact fit manner, the orifice of the liquid inlet hole 120 located in the first end surface, and it is ensured that a communication relationship may be formed between the communication hole 211 and the liquid drainage hole 110 in a manner of connecting with each other, thereby facilitating a normal liquid draining process.

Specifically, a surface of the first valve body 210 facing the first end surface includes a first part configured to fit with an area in the first end surface where the orifice of the liquid inlet hole 120 is located, and a surface of the first valve body 210 facing the first end surface further includes a second part configured to fit with an area in the first end surface where the orifice of the liquid drainage hole 110 is located. The foregoing first part is in a profiling design with the area in the first end surface where the orifice of the liquid inlet hole 120 is located, and the foregoing second part is in a profiling design with the area in the first end surface where in the orifice of the liquid drainage hole 110 is located, so as to ensure that the first valve body 210 forms a surface contact fit relationship with the first end surface, and the first valve body 210 can be configured to block the liquid inlet hole 120 and communicate the communication hole 211 and the liquid drainage hole 110. A specific embodiment is that, the first end surface is of a planar structure, and a surface of the first valve body 210 facing the first end surface may be of a planar structure. That is, when the first valve body 210 is in surface contact with the first end surface, the liquid inlet hole 120 is blocked, and the liquid drainage hole 110 is communicated with a space on one side of the first valve body 210 facing away from the diverter 100.

As shown in FIG. 1, the second valve body 220 may be in openable and closable surface contact with the second end surface of the diverter 100 to block the liquid drainage hole 110. That is, in the diverter assembly, the second valve body 220 has a capability of moving relative to the diverter 100, and in a process that the second valve body 220 moves in a direction closer to the diverter 100, the second valve body 220 may move to a state that the second valve body is in surface contact with the second end surface of the diverter 100. In this state, the second valve body 220 can block, in a surface contact fit manner, the orifice of the liquid drainage hole 110 located in the second end surface, to ensure a normal liquid inlet process.

Specifically, a surface of the second valve body 220 facing the second end surface is in a profiling design with the part of the second end surface where the liquid drainage hole 110 is located, so as to ensure that the second valve body 220 can be configured to block the liquid drainage hole 110 when a surface contact fit relationship is formed between the second valve body 220 and the second end surface. A specific embodiment is that, the second end surface is of a planar structure, and a surface of the second valve body 220 facing the second end surface may be of a planar structure. That is, when the second valve body 220 is in surface contact with the second end surface, the liquid drainage hole 110 is blocked.

In addition, to ensure that both the liquid inlet hole 120 and the liquid drainage hole 110 have relatively high reliability when blocked, as shown in FIG. 1 to FIG. 6, the first valve rubber 310 may be pressed between the first valve body 210 and the first end surface, and the second valve rubber 320 may be pressed between the second valve body 220 and the second end surface. As described above, both the first valve body 210 and the second valve body 220 have a capability of moving relative to the diverter 100. Therefore, the elastic first valve rubber 310 and second valve rubber 320 may be respectively pressed on the first end surface and the second end surface of the diverter 100 by the first valve body 210 and the second valve body 220.

In addition, the second valve rubber 320 surrounds outside the liquid drainage hole 110, when the liquid inlet process is performed, it may be ensured that the orifice of the liquid drainage hole 110 located in the second end surface can be sealed all the time, thereby ensuring relatively high sealing performance of the liquid drainage hole 110.

As shown in FIG. 1, the liquid inlet hole 120 is spaced apart from the liquid drainage hole 110 by the first valve rubber 310, and the first valve rubber 310 surrounds outside the liquid drainage hole 110, so that the liquid inlet hole 120 may be isolated from the liquid drainage hole 110 by using the first valve rubber 310 in a case that the first valve rubber 310 is pressed on the first end surface by the first valve body 210, thereby ensuring relatively high reliability of independent operation of the liquid inlet hole 120 and the liquid drainage hole 110.

In addition, to ensure relatively good isolation between the orifices of the liquid inlet holes 120 respectively located in the first end surface and the side surface, the diverter 100 and the valve box 500 may be assembled in a manner of interference fit, so that a reliable isolation relationship can be formed between the side face of the diverter 100 and the first end surface of the diverter 100.

Figure 10:
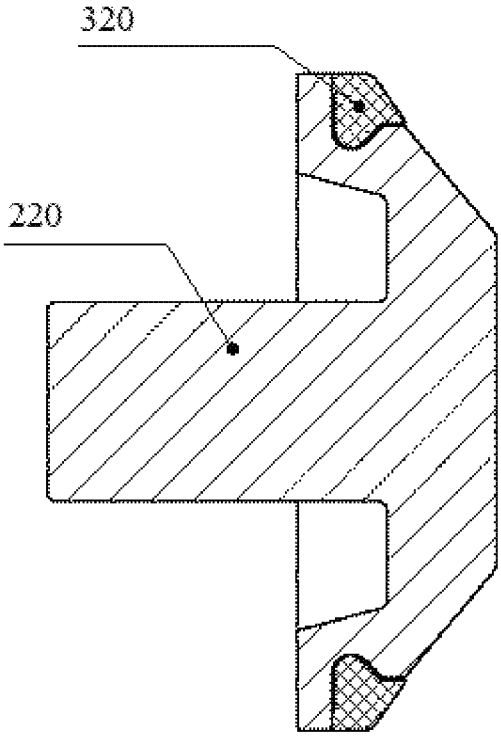
FIG. 10 is a cross-sectional schematic diagram of the structure shown in FIG. 8.

An embodiment of this disclosure describes a diverter assembly, which may be applied to a plunger pump, and is mounted in a valve box 500 in the plunger pump. In the diverter assembly, the diverter 100 is provided with a liquid drainage hole 110 that is communicated with a first end surface and a second end surface facing away from each other in an axial direction of the diverter 100, and a liquid inlet hole 120 of the diverter 100 is communicated with the first end surface and a side surface of the diverter 100. Further, when a liquid inlet process and a liquid draining process are performed by using the diverter 100, liquid has a tendency to flow in the axial direction of the diverter 100. Therefore, in a design and machining process of the valve box 500 corresponding to the diverter assembly, as shown in FIG. 10, FIG. 13, and FIG. 14, an alternating cavity 503, a low-pressure cavity 502, and a high-pressure cavity 501 in the valve box 500 can be distributed in a straight line direction (that is, the axial direction of the diverter 100). Then, in an operation process of a plunger pump including the diverter assembly, a force of the liquid acting on the diverter 100 (and the valve box 500) in a direction perpendicular to the axial direction of the diverter 100 can be relatively small or even zero. This can prevent a problem of stress concentration of the diverter 100 and the valve box 500, and prolong a service life of the valve box 500.

In addition, in the foregoing diverter assembly, both the first valve body 210 and the second valve body 220 may move relative to the diverter 100, so that the diverter assembly can be switched between a liquid inlet state and a liquid draining state. Meanwhile, when the liquid inlet process and the liquid draining process are separately performed, to ensure that both the liquid drainage hole 110 and the liquid inlet hole 120 may be stably blocked, and both the first valve body 210 and the second valve body 220 may respectively fit with the first end surface and the second end surface in a surface contact manner to separately provide a sealing function for the liquid inlet hole 120 and the liquid drainage hole 110, thereby ensuring high sealing reliability of the liquid inlet hole 120 or the liquid drainage hole 110.

Further, as shown in FIG. 1, the diverter assembly disclosed in this embodiment of this disclosure may further include third valve rubber 330. The third valve rubber 330 surrounds outside an orifice of the liquid inlet hole 120 located in the first end surface, and the third valve rubber 330 may be pressed between the first valve body 210 and the first end surface. That is, the third valve rubber 330 is further arranged on a periphery of the first valve rubber 310, the third valve rubber 330 is of an annular structure, and the orifice of the liquid inlet hole 120 located in the first end surface is sandwiched between the first valve rubber 310 and the third valve rubber 330. Correspondingly, in a process that the first valve body 210 moves closer to a direction in which the diverter 100 is located, the first valve body 210 may press the third valve rubber 330 together when pressing the first valve rubber 310. Under an action of the third valve rubber 330, two orifices of the liquid inlet hole 120 respectively located in the first end surface and the side face may be isolated, thereby further improving isolation reliability between the two orifices of the liquid inlet holes 120.

Figure 17:
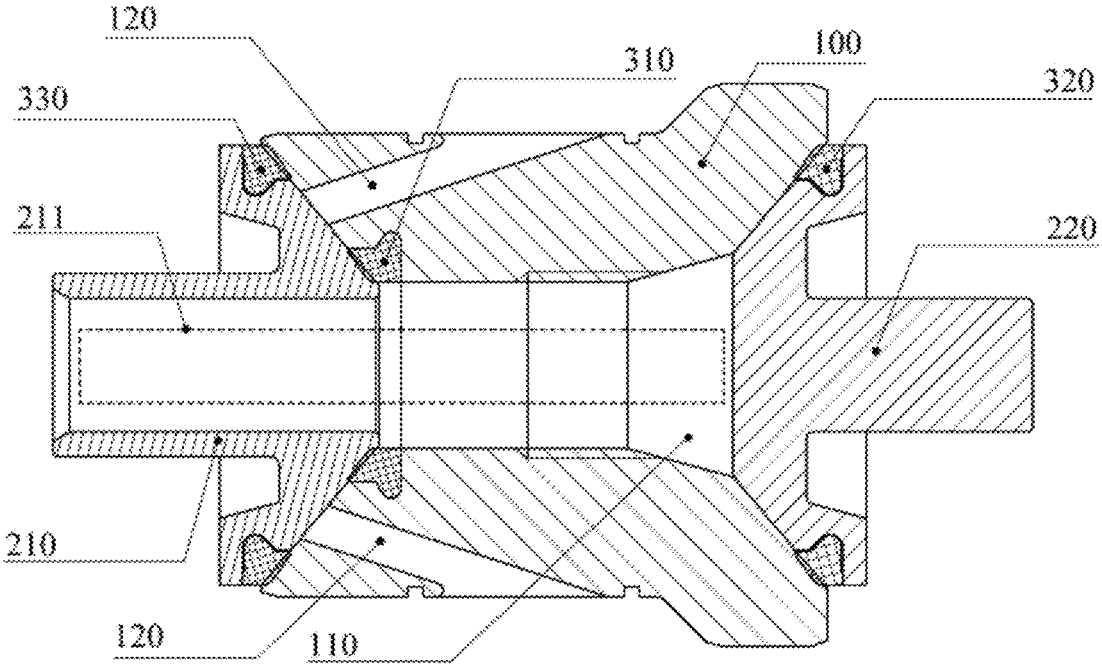
FIG. 17 is another schematic structural diagram of a diverter assembly according to an embodiment of this disclosure.
Figure 18:
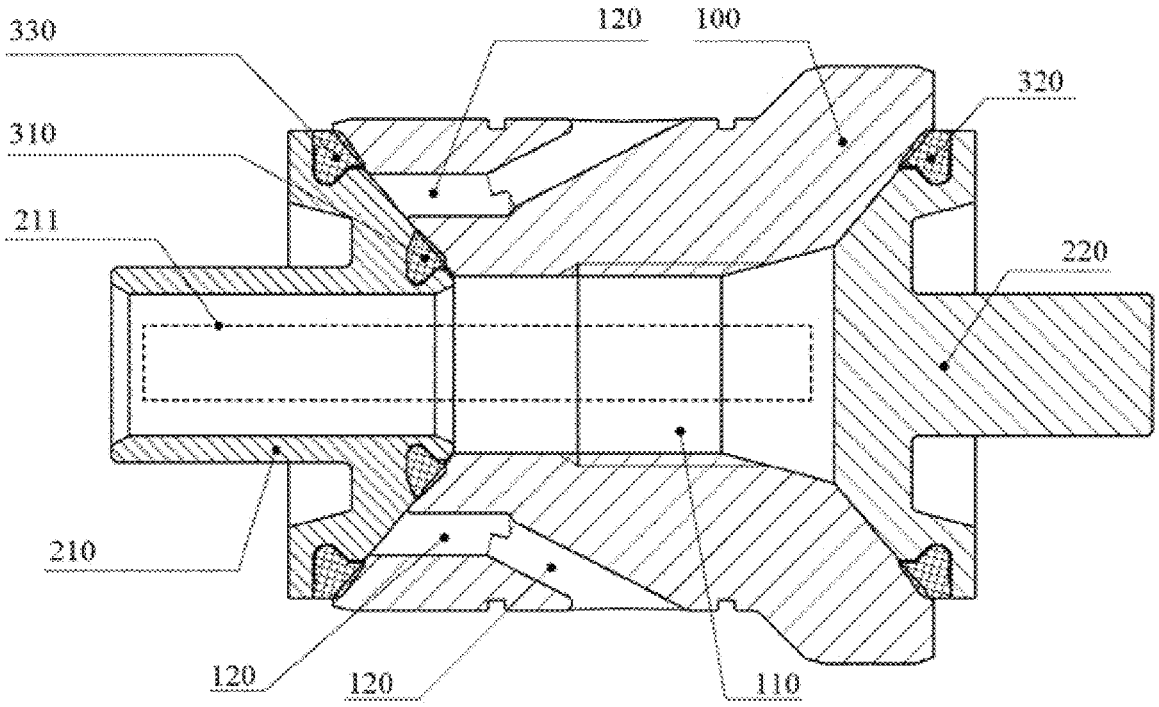
FIG. 18 is still another schematic structural diagram of a diverter assembly according to an embodiment of this disclosure.

To ensure relatively high position stability of the first valve rubber 310, a mounting slot may be provided to provide a limiting function for the first valve rubber 310. Specifically, as shown in FIG. 1 and FIG. 17, the foregoing mounting slot may be provided in the diverter 100 or the first valve body 210, and a cross-sectional shape of the mounting slot may be the same as a cross-sectional shape and a size of a part of the first valve rubber 310 accommodated in the mounting slot, thereby ensuring that the mounting slot can provide reliable accommodating and mounting functions for the first valve rubber 310.

Similarly, to ensure relatively high position stability of both the second valve rubber 320 and the third valve rubber 330, mounting slots may alternatively be correspondingly provided for the second valve rubber 320 and the third valve rubber 330. Specifically, as shown in FIG. 1, another mounting slot may alternatively be provided in the diverter 100 or the first valve body 210 to provide accommodating and mounting functions for the third valve rubber 330. Correspondingly, a mounting slot may be provided in the diverter 100 or the second valve body 220 to provide accommodating and mounting functions for the second valve rubber 320, thereby ensuring relatively high position stability of both the second valve rubber 320 and the third valve rubber 330.

To further improve an isolation effect of the orifice of the liquid inlet hole 120 located in the side surface of the diverter 100, optionally, as shown in FIG. 12, the diverter assembly disclosed in this embodiment of this disclosure may further include sealing rings 410. Both sides facing away from each other of the liquid inlet hole 120 located in the side surface are provided with the sealing rings 410.

That is, at least two sealing rings 410 are sleeved over the side surface of the diverter 100, and the orifice of the liquid inlet hole 120 located in the side surface of the diverter 100 is located between the two sealing rings 410. In this case, after the diverter 100 is assembled to the inner cavity 510 of the valve box 500, a cavity wall of the inner cavity 510 of the valve box 500 and the side surface of the diverter 100 may be sealed by using the sealing rings 410, so that the orifice of the liquid inlet hole 120 located in the side surface of the diverter 100 can be isolated, and liquid that needs to flow into the liquid inlet hole 120 is prevented from flowing to another area along a gap between the diverter 100 and the valve box 500.

The sealing ring 410 may be formed by using an elastic material such as rubber. Parameters such as a size of the sealing ring 410 may be determined according to an actual situation, and are not limited herein. To reduce mounting difficulty of the sealing ring 410, optionally, as shown in FIG. 1, the side surface of the diverter 100 is provided with a plurality of limiting slots 140, and parts of the plurality of sealing rings 410 may be respectively accommodated in the plurality of limiting slots 140 in one-to-one correspondence. That is, the side surface of the diverter 100 is provided with the limiting slots 140 that are sunken relative to the side surface of the diverter 100. In a manner that parts of the sealing rings 410 extend into the limiting slots 140, the limiting slots 140 may provide a limiting function for the sealing rings 410, and the plurality of limiting slots 140 may respectively provide a limiting function for the plurality of sealing rings 410, thereby ensuring a relatively good limiting effect of each sealing ring 410.

As described above, the first end surface may be of a planar structure. To improve fit stability between the first end surface and the first valve body 210, optionally, as shown in FIG. 4 and FIG. 17, the first end surface is of a flared structure from inside to outside. That is, in the first end surface, in the axial direction of the diverter 100, a distance between a part closer to the liquid drainage hole 110 and the second valve body 220 is smaller. Correspondingly, to ensure a surface contact fit relationship between the first valve body 210 and the first end surface, as shown in FIG. 7, the first valve body 210 is of a convex structure, and in the axial direction of the diverter 100, a distance between a part closer to the communication hole 211 of the first valve body 210 and the second valve body 220 is smaller, so that the first valve body 210 can "extend into" the first end surface, and form a surface contact fit relationship with the first end surface, thereby ensuring that the limiting fit relationship can be formed between the first valve body 210 and the diverter 100 in a direction perpendicular to the axial direction of the diverter 100 (that is, a radial direction of the diverter 100).

More specifically, the first end surface may be (approximate to) a side surface-like structure of a circular truncated cone, and similarly, a side surface of the first valve body 210 may alternatively be (approximate to) the side surface-like structure of the circular truncated cone, to ensure that a reliable surface fit relationship can be formed between the first valve body 210 and the first end surface.

Optionally, as shown in FIG. 4 and FIG. 10, the second end surface has a flared structure from inside to outside, and the second valve body 220 has a structure corresponding to the second end surface, to ensured that a limiting fit relationship may be formed between the second valve body 220 and the diverter 100 in a direction perpendicular to the axial direction of the diverter 100 while forming a reliable surface fit relationship between the second valve body 220 and the second end surface.

Figure 19:
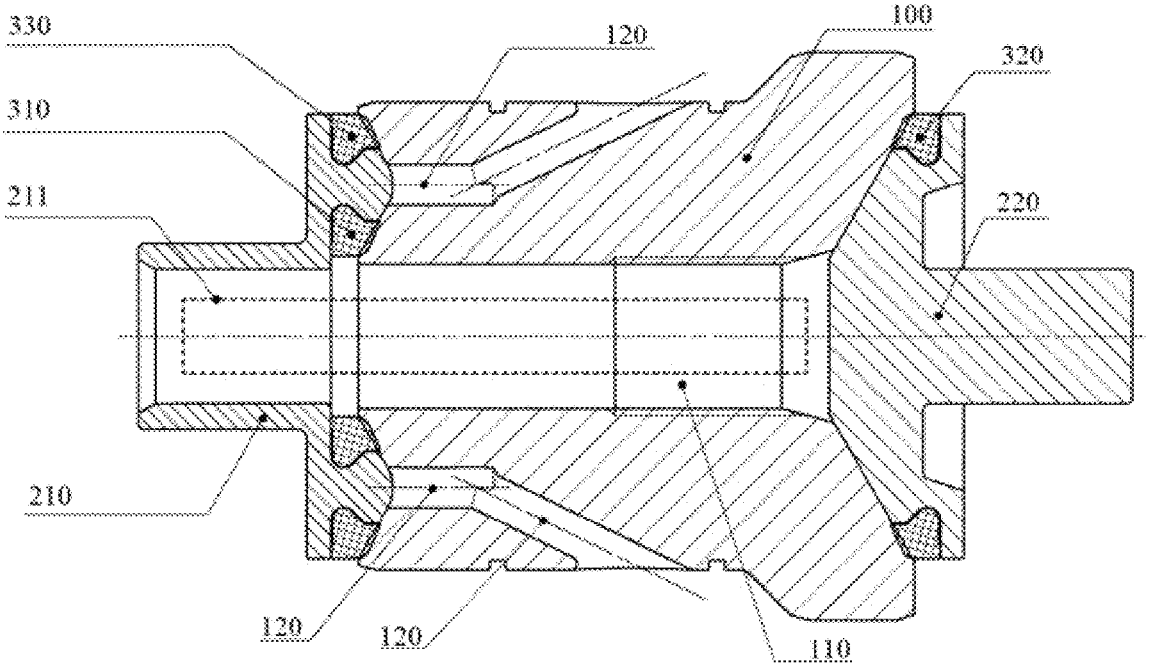
FIG. 19 is yet another schematic structural diagram of a diverter assembly according to an embodiment of this disclosure.

As described above, the first end surface may be the side surface-like structure of the circular truncated cone. In this case, a line segment obtained by intercepting the first end surface by a plane passing through an axis of the diverter 100 is a straight line segment. In another embodiment of this disclosure, the first end surface may alternatively be of another special-shaped structure. Optionally, as shown in FIG. 19, the first end surface is provided with a sunken area. Specifically, an area in the first end surface where the orifice of the liquid inlet hole 120 is located may be sunken closer to a direction of the second valve body 220 relative to an inner edge and an outer edge of the first end surface. In other words, in this embodiment, a line segment obtained by intercepting an area in the first end surface corresponding to the orifice of the liquid inlet hole 120 by the plane passing through the axis of the diverter 100 may include two arc line segments (or straight line segments) that are spaced apart from each other, an area where the two arc line segments (or the straight line segments) are spaced apart from each other is the area where the orifice of the liquid inlet hole 120 is located, and the two arc line segments that are spaced apart from each other expand and extend outward from the orifice of the liquid inlet hole 120 relative to the axis of the diverter 100 and are respectively connected to an outer edge of the diverter 100 and a side wall of the liquid drainage hole 110.

In a case that this technical solution is adopted, as shown in FIG. 19, an area corresponding to the first valve body 210 is of a convex structure, which can ensure that a reliable surface contact fit relationship can still be formed between the first end surface and the first valve body 210. In addition, in a case that the foregoing technical solution is adopted, the "sunken structure" on the first end surface may provide a guide function for a mounting process of the first valve body 210, and the first end surface and the first valve body 210 can form a limiting fit relationship in a radial direction of the diverter 100, thereby improving stability of the fit relationship between the first valve body 210 and the first end surface.

As described above, the liquid drainage hole 110 is located in an area where the axis of the diverter 100 is located, and the liquid inlet hole 120 is provided with an orifice in the first end surface. Therefore, the orifice of the liquid inlet hole 120 in the first end surface may be considered as being located around the liquid drainage hole 110. In a case that one liquid inlet hole 120 is provided, the liquid inlet hole 120 is located on one side of the liquid drainage hole 110. As shown in FIG. 2, in a case that two or more liquid inlet holes 120 are provided, the plurality of liquid inlet holes 120 are provided around the liquid drainage hole 110, and the plurality of liquid inlet holes 120 may be uniformly surround the liquid drainage hole 110 in a manner of spacing apart from each other, so that in a liquid inlet process of the diverter assembly, liquid may be uniformly fed from the plurality of liquid inlet holes 120 to a space on one side where the first end surface of the diverter 100 is located. On one hand, liquid inlet efficiency can be improved, and on the other hand, it can be ensured that a liquid inlet rate at any position of the first end surface is basically equivalent, and work stability of the diverter assembly is improved. More specifically, two, three, or more liquid inlet holes 120 may be provided in the diverter 100. A specific quantity of the liquid inlet holes 120 may be determined according to parameters such as a hole diameter of the liquid inlet hole 120 and a diameter of the diverter 100, and is not limited herein.

In a case that a plurality of liquid inlet holes 120 are provided, specific structures of areas corresponding to the orifices of the liquid inlet holes 120 in the first end surface may be different or partially different from each other. In another embodiment of this disclosure, as shown in FIG. 2, specific structures of areas corresponding to the orifices of the liquid inlet holes 120 in the first end surface may be the same, which can reduce difficulty in forming the first valve body 210, and reduce difficulty in assembling the first valve body 210 and the first end surface.

As described above, two line segments obtained by intercepting the area in the first end surface where the liquid inlet hole 120 is located by a plane passing through the axis of the diverter 100 may be arc line segments, or may alternatively be straight line segments. Correspondingly, line segments obtained by intercepting a surface of the first valve body 210 configured to fit the first end surface by the plane passing through the axis of the diverter 100 may correspondingly include an arc line segment or a straight line segment, and are separately in surface contact with a corresponding area on the first end surface.

As shown in FIG. 1, in a process of blocking the orifice of the liquid inlet hole 120 located in the first end surface by using the first valve body 210, a surface of the first valve body 210 facing the first end surface includes a part that is in contact with the first end surface and a part that is configured to block the liquid inlet hole 120, and the two structures are connected with each other. A pattern formed by intercepting a part of the first valve body 210 configured to block the liquid inlet hole 120 by the plane passing through the axis of the diverter 100 includes a first line segment, that is, an area corresponding to the first line segment in the surface of the first valve body 210 facing the first end surface is configured to block the liquid inlet hole 120.

Figure 21:
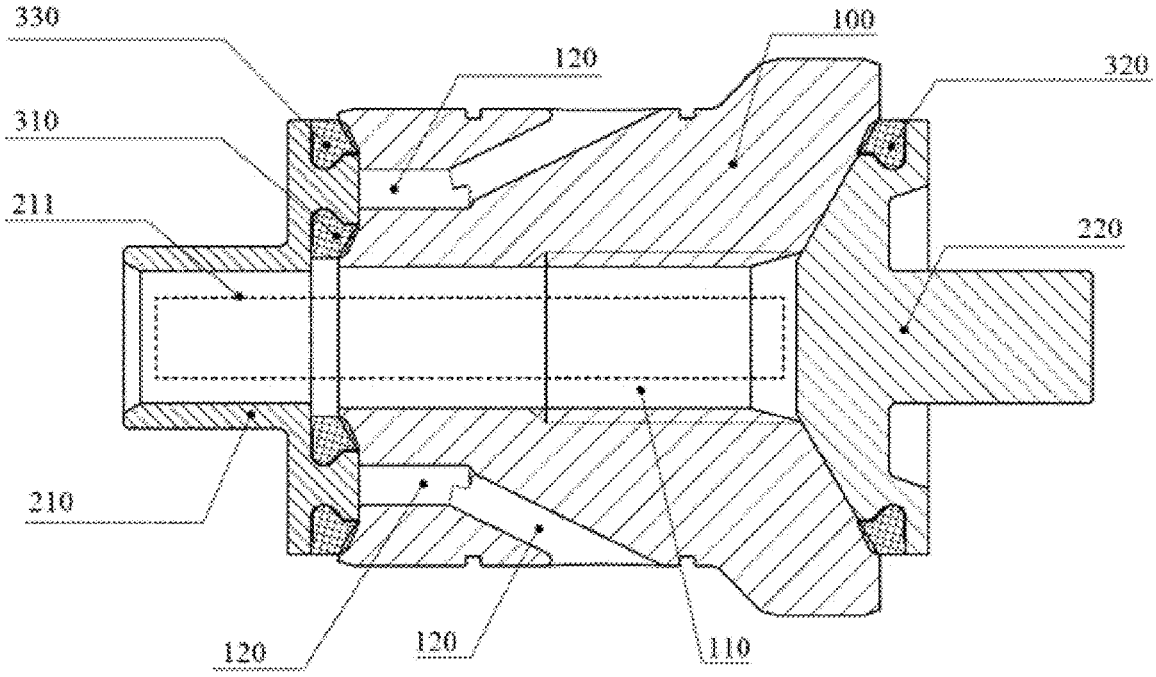
FIG. 21 is yet another schematic structural diagram of a diverter assembly according to an embodiment of this disclosure.
Figure 22:
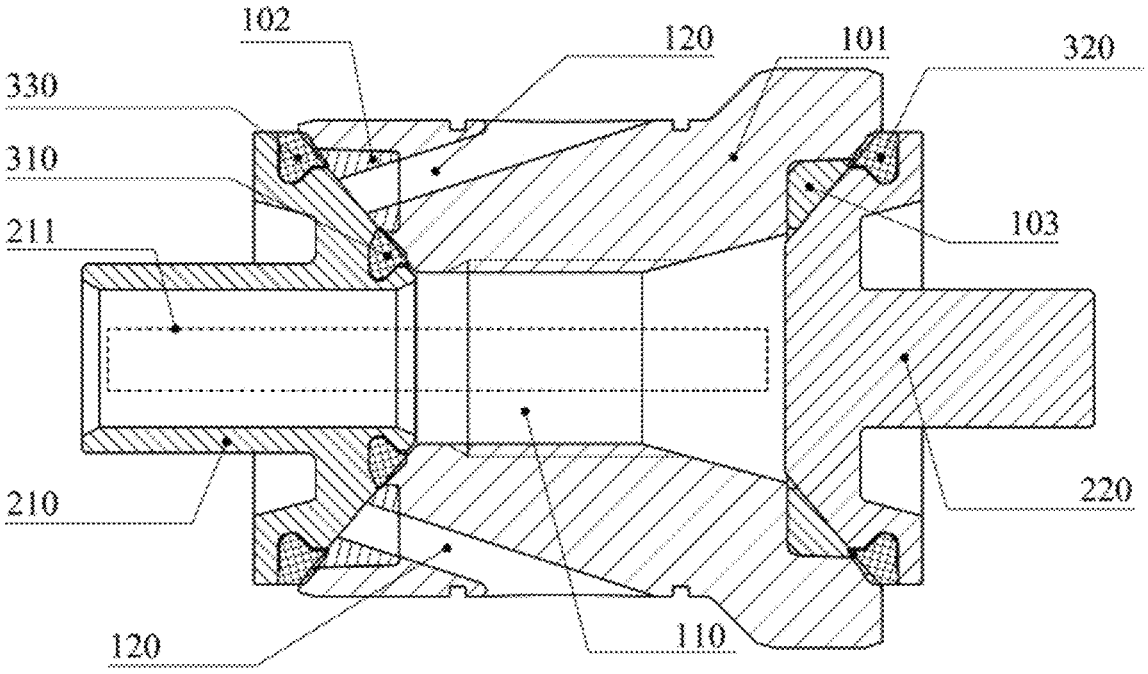
FIG. 22 is yet another schematic structural diagram of a diverter assembly according to an embodiment of this disclosure.

Optionally, as shown in FIG. 1, FIG. 17, FIG. 21, and the like, the first line segment is a straight line segment, and the straight line segment is perpendicular to an axial direction of the orifice of the liquid inlet hole 120 located in the first end surface. In this case, the first valve body 210 may provide a blocking acting force opposite to a liquid outlet direction of the liquid inlet hole 120 for the liquid inlet hole 120, so that an effect of blocking the liquid inlet hole 120 by the first valve body 210 is relatively good, thereby improving an effect of blocking the liquid inlet hole 120.

Figure 20:
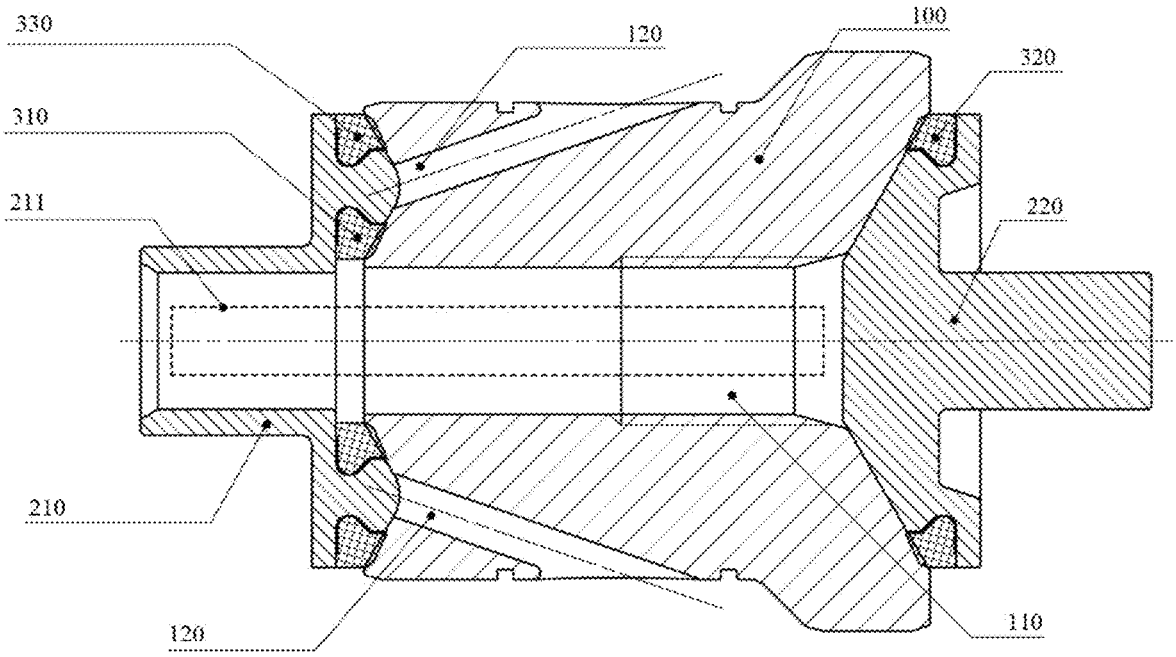
FIG. 20 is yet another schematic structural diagram of a diverter assembly according to an embodiment of this disclosure.

Alternatively, as shown in FIG. 19 and FIG. 20, the foregoing first line segment may alternatively be an arc line segment, and a middle part of the first line segment is provided in a manner of protruding inwards the liquid inlet hole 120 in the axial direction of the orifice of the liquid inlet hole 120 located in the first end surface, so that the a part of the first valve body 210 configured to fit the liquid inlet hole 120 may provide a function of "a bottle cork", thereby improving an effect of blocking the liquid inlet hole 120 by the first valve body 210 in a manner of partially extending into the interior of the liquid inlet hole 120.

As described above, both the first valve body 210 and the second valve body 220 are in surface contact with the diverter 100. Optionally, the diverter 100 may be formed by using a metal material having relatively high hardness in a manner such as integrated die-casting, to prolong a service life of the diverter 100, and ensure that the surface fit relationship between the first end surface and the first valve body 210 and between the second end surface and the second valve body 220 may be maintained in a relatively stable state all the time.

In another embodiment of this disclosure, as shown in FIG. 22 to FIG. 25, the diverter 100 may include a matrix 101 and a first wear ring 102. The first wear ring 102 may be formed by using a material having higher hardness and higher wear resistance than those of the matrix 101. Specifically, the first wear ring 102 may be formed by using at least one of a cemented carbide such as zirconium oxide, nickel-based tungsten carbide, cobalt-based tungsten carbide, titanium carbide, and boron nitride, to ensure that the first wear ring 102 has relatively strong wear resistance and hardness. In addition, the matrix 101 is formed by using a material having relatively low hardness and wear resistance, so that production costs of the entire diverter 100 can be reduced.

In a process of assembling the matrix 101 and the first wear ring 102, the matrix 101 is provided with a first accommodation slot, and the first wear ring 102 is embedded in the first accommodation slot, so that partial strength and wear resistance of the diverter 100 are improved by using surface contact between the first wear ring 102 and the first valve body 210, thereby reducing overall costs of the diverter while ensuring a relatively long service life and a relatively good sealing effect of the diverter 100.

Figure 23:
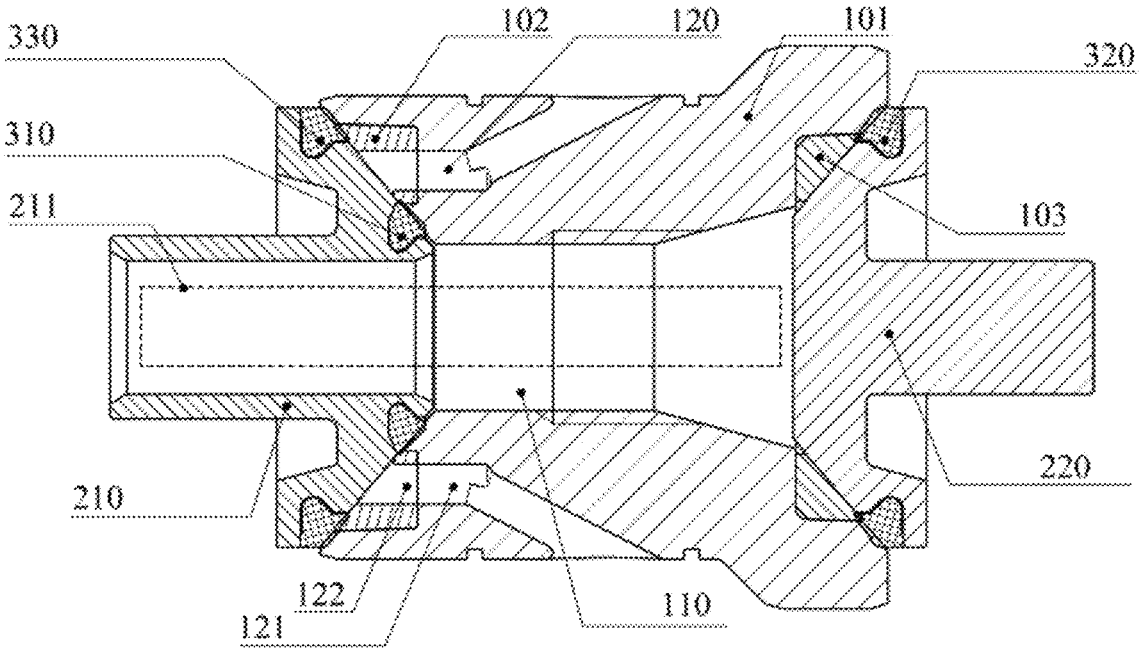
FIG. 23 is yet another schematic structural diagram of a diverter assembly according to an embodiment of this disclosure.
Figure 24:
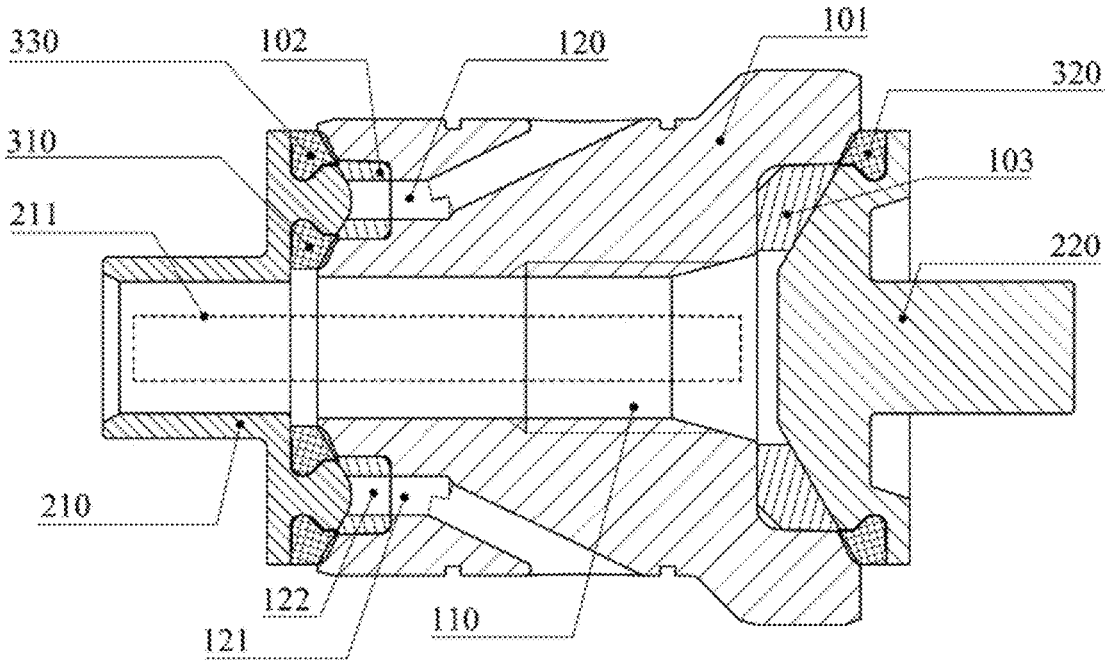
FIG. 24 is yet another schematic structural diagram of a diverter assembly according to an embodiment of this disclosure.
Figure 25:
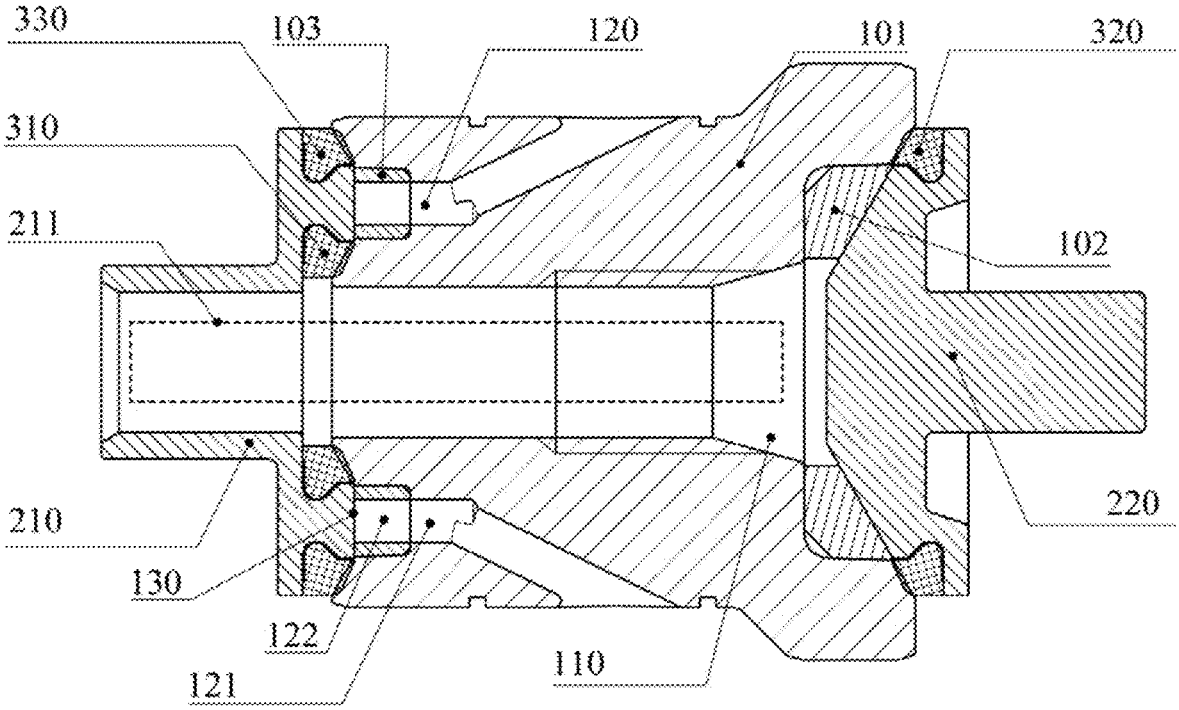
FIG. 25 is still another schematic structural diagram of a diverter assembly according to an embodiment of this disclosure.

In addition, because the liquid inlet hole 120 is located in the diverter 100, then in a case that the diverter 100 includes the first wear ring 102, as shown in FIG. 23 to FIG. 25, the liquid inlet hole 120 may include a first hole segment 121 and a second hole segment 122. The first hole segment 121 and the second hole segment 122 are communicated with each other, to ensure that liquid on a side surface of the diverter 100 can still be fed, through the first hole segment 121 and the second hole segment 122, into a space on one side where the first end surface of the diverter 100 is located.

The first hole segment 121 is located on the matrix 101, and the second hole segment 122 is located on the first wear ring 102, so that the first wear ring 102 can be in surface contact with the first valve body 210, thereby ensuring a relatively long service life and a relatively good sealing effect when the first wear ring 102 is in frequent contact with the first valve body 210. In addition, a diameter of the first hole segment 121 and a diameter of the second hole segment 122 may be different. To improve smoothness of a liquid inlet process, the diameter of the first hole segment 121 and the diameter of the second hole segment 122 may be the same, and an outer edge of the first hole segment 121 and an outer edge of the second hole segment 122 may be butted with each other.

Based on the foregoing embodiment, correspondingly, as shown in FIG. 22 to FIG. 25, the diverter 100 may further include a second wear ring 103, at least a part of the second end surface is located on the second wear ring 103, and the second wear ring 103 is configured to be in surface contact with the second valve body 220, so that the second wear ring 103 is used as a component that is on one side of the diverter 100 facing away from the first valve body 210 and that is in direct contact with the second valve body 220, thereby ensuring that both the second valve body 220 and the second wear ring 103 can still have a long service life and a good sealing effect in a case that the second valve body 220 is in frequent contact with the second wear ring 103 for a long time.

Correspondingly, a material of the second wear ring 103 may be the same as a material of the first wear ring 102, and a second accommodation slot may be correspondingly formed in a second end surface, so that both the first wear ring 102 and the second wear ring 103 may be respectively embedded in the first accommodation slot and the second accommodation slot in a manner such as interference fit, thereby forming a stable relative fixed relationship between both the first wear ring 102 and the second wear ring 103 and the matrix 101.

As described above, the liquid inlet hole 120 is communicated with the side face and the first end surface of the diverter 100. In this case, as shown in FIG. 1, FIG. 17, FIG. 20, and FIG. 22, the liquid inlet hole 120 may be of a linear structure. In addition, the liquid inlet hole 120 is obliquely provided relative to the axial direction of the diverter 100, it can be ensured that the liquid inlet hole 120 can communicate the side face and the first end surface of the diverter 100. In addition, a process of transferring transferred liquid in the liquid inlet hole 120 is relatively smooth, and resistance to flow of the liquid in the liquid inlet hole 120 is reduced. In addition, in a case that the foregoing technical solution is adopted, machining difficulty of the liquid inlet hole 120 can be reduced.

In another embodiment of this disclosure, as shown in FIG. 18, FIG. 19, FIG. 21, FIG. 23, FIG. 24, and FIG. 25, the liquid inlet hole 120 may include an axial section and an inclined section, and the axial section and the inclined section are communicated with each other. That is, the liquid inlet hole 120 includes at least two sections, and axial directions of the two sections are provided in a non-parallel manner. In addition, the axial section extends in the axial direction of the diverter 100 and is communicated with a first end surface, and the inclined section extends obliquely relative to the axial direction of the diverter 100 and is communicated with a side surface, so that a liquid outlet direction of the liquid inlet hole 120 is parallel to the axial direction of the diverter 100, and the liquid outlet direction of the liquid inlet hole 120 is parallel to a movement direction of the first valve body 210, thereby improving stress uniformity of the first valve body 210. Specifically, communication between the axial section and the inclined section may be ensured by machining the axial section of the liquid inlet hole 120 from the first end surface and obliquely machining the inclined section from the side surface of the diverter 100, so that the liquid inlet hole 120 required to be protected in this embodiment may be formed.

In the diverter assemblies of a plurality of structures disclosed in the foregoing embodiments of this disclosure, technical solutions may be combined with each other. For example, in a case that the diverter 100 includes the matrix 101, the first wear ring 102, and the second wear ring 103, the first end surface of the entire diverter 100 may be of a flared structure or a planar structure, or, the first end surface may be sunken from a middle part of a radial direction of the first end surface to a direction in which the second valve body 220 is located. For another example, a diverter assembly of any structure may be provided with the third valve body and/or the sealing ring 410, to improve a sealing effect between spatial structures in the diverter assembly. Considering brief text, various structures are not combined one by one herein again for repeated description.

Based on the foregoing diverter assembly, an embodiment of this disclosure further discloses a valve box 500. The valve box 500 and the diverter assembly fit with each other for use, and both the valve box 500 and the diverter assembly are applicable to a plunger pump as two main components of the plunger pump. The diverter assembly may be mounted in the valve box 500.

Figure 11:
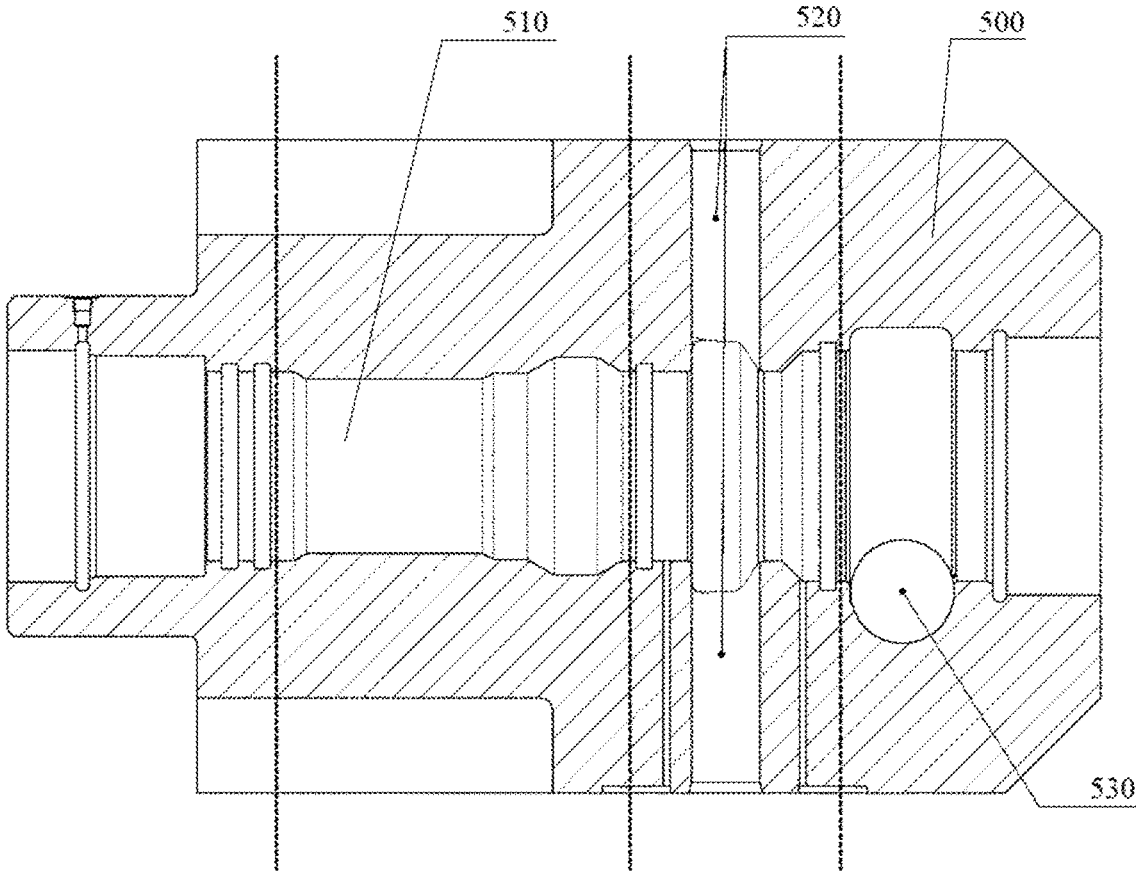
FIG. 11 is a schematic structural diagram of a valve box according to an embodiment of this disclosure.

Specifically, the valve box 500 has an inner cavity 510, a liquid inlet channel 520, and a liquid drainage channel 530. The inner cavity 510 is configured to mount the diverter assembly, so that a part of the inner cavity 510 is divided by the diverter assembly into a high-pressure cavity 501, a low-pressure cavity 502, and an alternating cavity 503 (as shown in FIG. 13 and FIG. 14). In FIG. 11, the valve box 500 is divided into four parts by three dashed lines. The four parts may be respectively, from right to left, the high-pressure cavity 501, the low-pressure cavity 502, the alternating cavity 503, and a plunger cavity. The plunger cavity is configured to accommodate a plunger 710. Apparently, the alternating cavity 503 of the foregoing valve box 500 does not have a cross-intersecting line structure, and the transition between different cavities is smooth, so that stress of the valve box 500 can be reduced, and the service life of the valve box 500 can be prolonged.

In addition, as shown in FIG. 11 and FIG. 12, the liquid inlet channel 520 is communicated with a liquid inlet hole 120 of the diverter assembly, and the liquid drainage channel 530 may be communicated with a liquid drainage hole 110 of the diverter assembly. Then, as shown in FIG. 15 and FIG. 16, liquid in the liquid inlet channel 520 may be fed from the liquid inlet hole 120 of the diverter assembly to the space on the side where the first end surface of the diverter 100 is located, and then the liquid fed into the space on the side where the first end surface of the diverter 100 is located may be fed, from the communication hole 211 of the first valve body 210 and the liquid drainage hole 110 of the diverter 100, into a space on one side where the second end surface of the diverter 100 is located to complete a liquid inlet process and a liquid draining process.

Based on the diverter assembly and the foregoing valve box 500 disclosed in the foregoing embodiments, as shown in FIG. 12 to FIG. 16, an embodiment of this disclosure further discloses a plunger pump. The plunger pump includes a plunger 710, any one of the foregoing diverter assemblies, and the foregoing valve box 500. Both the plunger 710 and the diverter assembly are mounted in an inner cavity 510 of the valve box 500. The plunger 710 and the diverter assembly are distributed in an axial direction of a rotation axis. The plunger 710 is in transmission connection with the first valve body 210. A power end may realize force transferring through the plunger 710 and the first valve body 210. Certainly, as shown in FIG. 12, the plunger pump may further include components such as a gland 720, a pressing cap 730, a packing assembly 740, a packing pressing cap 751, a packing pressing ring 752, a packing spacing ring 753, a packing wear sleeve 760, and a clamp 770.

On the basis of the foregoing plunger pump, as shown in FIG. 12, both sides facing away from each other of an orifice of the liquid inlet hole 120 located in a side surface in an axial direction are provided with sealing rings 410, so that sealing and isolating functions can be further provided for an orifice of the liquid inlet hole 120 located in the side surface by using the sealing rings 410.

Further, as shown in FIG. 12, a sealing loop 420 may be arranged on an outer side of each sealing ring 410 on a periphery of the diverter 100, and the sealing loop 420 is hermetically arranged between the valve box 500 and the diverter 100. That is, the sealing ring 410 and the sealing loop 420 are arranged on the periphery of the diverter 100, the sealing ring 410 is sandwiched between two adjacent sealing loops 420, and the orifice of the liquid inlet hole 120 located in the side surface of the diverter 100 is sandwiched by the sealing rings 410, so that reliability of a sealing connection between the side face of the diverter 100 and a cavity wall of the inner cavity 510 of the valve box 500 is further enhanced by using the sealing loop 420.

In addition, based on the foregoing technical solution, as shown in FIG. 12 to FIG. 14, a discharge hole 540 may be provided in the valve box 500, and an orifice of the discharge hole 540 is communicated between the sealing ring 410 and the sealing loop 420 located on the same side of the liquid inlet hole 120. In this case, if liquid overflows in the discharge hole 540, it may be determined that the sealing ring 410 corresponding to a position of the discharge hole 540 is damaged, so as to facilitate in-time replacement of the sealing ring 410 at a corresponding position by working personnel, and prevent other components in the valve box 500 and the diverter assembly from being damaged because a damaged sealing ring 410 cannot replaced in time.

Correspondingly, in a case that both sides facing away from each other of the liquid inlet hole 120 located in the side surface are provided with the sealing rings 410 and the sealing loops 420, as shown in FIG. 12, both sides facing away from each other of the liquid inlet hole 120 are provided with discharge holes 540, so that information can be obtained through the corresponding discharge hole 540 in a case that any sealing ring 410 is damaged.

To reduce a quantity of the discharge holes 540 that need to be monitored, as shown in FIG. 13 and FIG. 14, one discharge hole 540 may be provided, and a connecting hole 160 may be provided in the diverter 100. One end of the connecting hole 160 is communicated between the sealing loop 420 and the sealing ring 410 that are located on one side of the liquid inlet hole 120 facing away from the discharge hole 540, and the other end of the connecting hole 160 is communicated with the discharge hole 540. Then, a space between the sealing ring 410 and the sealing loop 420 on one side of the liquid inlet hole 120 may be directly communicated with an exterior of the valve box 500 through the discharge hole 540, and a space between the sealing ring 410 and the sealing loop 420 on the other side of the liquid inlet hole 120 may be indirectly communicated with the discharge hole 540 and communicated with the exterior of the valve box 500 through the connecting hole 160. This may alternatively ensure that when any sealing ring 410 on the two sides of the liquid inlet hole 120 facing away from each other is damaged, it may be determined according to whether liquid overflows from the discharge hole 540, a quantity of provided discharge holes 540 can be reduced, and overall structural strength of the valve box 500 can be enhanced, thereby improving stability and reliability of the valve box 500.

The foregoing embodiments of this disclosure focus on describing differences between the embodiments. Different optimization features between the embodiments may be combined to form better embodiments as long as there is no contradiction. Considering brief text, details are not described herein again.

The foregoing descriptions are merely embodiments of this disclosure and are not intended to limit this disclosure. For a person skilled in the art, various modifications and variations can be made to this disclosure. Any modification, equivalent replacement, or improvement made without departing from the spirit and principle of this disclosure shall fall within the scope of the claims of this disclosure.

What is claimed is:

1. A diverter assembly, applied to a plunger pump, and comprising a diverter (100), a first valve body (210), a second valve body (220), first valve rubber (310), and second valve rubber (320), wherein the diverter (100) is provided with a liquid drainage hole (110) and a liquid inlet hole (120), the liquid drainage hole (110) is communicated with a first end surface and a second end surface facing away from each other of the diverter (100) in an axial direction of the diverter (100), the liquid inlet hole (120) is communicated with a side surface and the first end surface of the diverter (100), the side surface is connected between the first end surface and the second end surface, an orifice of the liquid inlet hole (120) located in the side surface is capable of being communicated with a liquid inlet channel of a valve box of the plunger pump, and an orifice of the liquid drainage hole (110) located in the second end surface is capable of being communicated with a liquid drainage channel of the valve box;

the first valve body (210) is provided with a communication hole (211) penetrating through the first valve body (210) in the axial direction, the first valve body (210) is in openable and closable surface contact with the first end surface of the diverter to block the liquid inlet hole (120) and communicate the communication hole (211) and the liquid drainage hole (110) when closed, the second valve body (220) is in openable and closable surface contact with the second end surface of the diverter to block the liquid drainage hole (110) when closed;

both the first valve rubber (310) and the second valve rubber (320) surround outside the liquid drainage hole (110), the liquid inlet hole (120) is spaced apart from the liquid drainage hole (110) through the first valve rubber (310), the first valve rubber (310) is capable of being pressed between the first valve body (210) and the first end surface, and the second valve rubber (320) is capable of being pressed between the second valve body (220) and the second end surface; and the diverter is provided with:

a diverter body, a first accommodation slot, and a first wear ring (102), the first wear ring (102) being embedded in the first accommodation slot, the liquid inlet hole (120) comprising a first hole segment (121) and a second hole segment (122) that are communicated with each other, the first hole segment (121) being in the diverter body, the second hole segment (122) being located in the first wear ring (102), and the first wear ring (102) being configured to be in surface contact with the first valve body (210); and/or a second wear ring (103), at least part of the second end surface being located on the second wear ring (103), and the second wear ring (103) being configured to be in surface contact with the second valve body (220).

2. The diverter assembly according to claim 1, wherein the diverter assembly further comprises a third valve rubber (330), the third valve rubber (330) surrounds outside the orifice of the liquid inlet hole (120) located in the first end surface, and the third valve rubber (330) is capable of being pressed between the first valve body (210) and the first end surface.

3. The diverter assembly according to claim 1, further comprising sealing rings, wherein both sides facing away from each other of the orifice of the liquid inlet hole (120) located in the side surface in the axial direction are provided with the sealing rings, a plurality of limiting slots (140) are formed in the side surface of the diverter (100), and parts of the sealing rings are respectively accommodated in the plurality of limiting slots (140) in one-to-one correspondence.

4. The diverter assembly according to claim 1, wherein the first end surface is of a flared structure from inside to outside, and/or the second end surface is of a flared structure from inside to outside.

5. The diverter assembly according to claim 1, wherein an area in the first end surface where the orifice of the liquid inlet hole (120) is located is sunken closer to a direction in which the second valve body (220) is located relative to an inner edge and an outer edge of the first end surface.

6. The diverter assembly according to claim 1, wherein a pattern formed by intercepting a part of the first valve body (210) configured to block the liquid inlet hole (120) by a plane passing through an axis of the diverter (100) comprises a first line segment, the first line segment is a straight line segment, and the straight line segment is perpendicular to an axial direction of an orifice of the liquid inlet hole located in the first end surface; or the first line segment is an arc line segment, and a middle part of the first line segment is provided to be convex toward an inside of the liquid inlet hole (120) in an axial direction of the orifice of the liquid inlet hole (120) located in the first end surface.

7. The diverter assembly according to claim 1, wherein a mounting slot is provided in the diverter (100) or the first valve body (210), and a part of the first valve rubber (310) is mounted in the mounting slot.

8. The diverter assembly according to claim 1, wherein the liquid inlet hole (120) is of a linear structure, and the liquid inlet hole (120) is obliquely provided relative to the axial direction of the diverter (100); or the liquid inlet hole (120) comprises an axial section and an inclined section that are communicated with each other, and the axial section extends in the axial direction of the diverter (100) and is communicated with the first end surface; and the inclined section is inclined relative to the axial direction of the diverter (100) and is communicated with the side surface.

9. The diverter assembly according to claim 1, wherein a plurality of liquid inlet holes (120) are provided, and the plurality of liquid inlet holes (120) uniformly surround outside of the liquid drainage hole (110) in a manner of spacing apart from each other.

10. The valve box of claim 1, applied to the plunger pump, and having an inner cavity, the liquid inlet channel, and the liquid drainage channel, wherein the inner cavity is configured to mount the diverter assembly, the liquid inlet channel is communicated with the liquid inlet hole (120) of the diverter assembly, and the liquid drainage channel is capable of being communicated with the liquid drainage hole (110) of the diverter assembly.

11. A plunger pump, comprising a plunger, a diverter assembly, and a valve box, wherein both the plunger and the diverter assembly are mounted in an inner cavity of the valve box, the plunger is in transmission connection with a first valve body (210), and the diverter assembly comprises:

a diverter assembly, and comprising a diverter (100), the first valve body (210), a second valve body (220), first valve rubber (310), and second valve rubber (320), wherein:

the diverter (100) is provided with a liquid drainage hole (110) and a liquid inlet hole (120), the liquid drainage hole (110) is communicated with a first end surface and a second end surface facing away from each other of the diverter (100) in an axial direction of the diverter (100), the liquid inlet hole (120) is communicated with a side surface and the first end surface of the diverter (100), the side surface is connected between the first end surface and the second end surface, an orifice of the liquid inlet hole (120) located in the side surface is capable of being communicated with a liquid inlet channel of a valve box of the plunger pump, and an orifice of the liquid drainage hole (110) located in the second end surface is capable of being communicated with a liquid drainage channel of the valve box;

the first valve body (210) is provided with a communication hole (211) penetrating through the first valve body (210) in the axial direction, the first valve body (210) is in openable and closable surface contact with the first end surface of the diverter to block the liquid inlet hole (120) and communicate the communication hole (211) and the liquid drainage hole (110) when closed, the second valve body (220) is in openable and closable surface contact with the second end surface of the diverter to block the liquid drainage hole (110) when closed;

both the first valve rubber (310) and the second valve rubber (320) surround outside the liquid drainage hole (110), the liquid inlet hole (120) is spaced apart from the liquid drainage hole (110) through the first valve rubber (310), the first valve rubber (310) is capable of being pressed between the first valve body (210) and the first end surface, and the second valve rubber (320) is capable of being pressed between the second valve body (220) and the second end surface; and both sides facing away from each other of the orifice of the liquid inlet hole (120) located in the side surface in the axial direction are provided with sealing rings, a sealing loop is arranged on an outer side of each sealing ring on a periphery of the diverter, the sealing loop is hermetically arranged between the valve box and the diverter, the valve box is provided with a discharge hole, and an orifice of the discharge hole is communicated between the sealing ring and the sealing loop located on the same side of the liquid inlet hole.

12. The plunger pump according to claim 11, wherein one discharge hole is provided, the diverter is provided with a connecting hole, and one end of the connecting hole is communicated between the sealing loop and the sealing ring located on one side of the liquid inlet hole (120) facing away from the discharge hole, and the other end of the connecting hole is communicated with the discharge hole.

* * * * *